US005879057A

United States Patent [19]

Schwoebel et al.

[11] Patent Number: 5,879,057

[45] Date of Patent: Mar. 9, 1999

[54] HORIZONTAL REMOTE MINING SYSTEM, AND METHOD

[75] Inventors: Jeffrey J. Schwoebel, Free Union; Carl W. Smith, Charlottesville; William J. Peters, Big Stone, all of Va.

[73] Assignee: Amvest Corporation, Charlottesville, Va.

[21] Appl. No.: 745,459

[22] Filed: Nov. 12, 1996

[51] Int. Cl.[6] ..... E21C 25/60; E21C 35/20

[52] U.S. Cl. ..... 299/17; 175/62; 299/56

[58] Field of Search ..... 299/11, 12, 7, 299/17, 56; 175/62, 67

[56] References Cited

U.S. PATENT DOCUMENTS

Re. 29,021 11/1976 Archibald et al. ..... 175/213
1,851,565 3/1932 Clayton .

(List continued on next page.)

OTHER PUBLICATIONS

"Section 6.0: Mining Applications and Water Jet Assisted Technology", Drs. Savanick and Hood, G. Knight, E. Thimons, *Journal of Engineering for Industry,* vol. 3, No. 2, May 1992; 36 pgs.

"Jet–Assisted Mechanical Drilling of Oil and Gas Wells", Veenhuizen et al., 7th American Water Jet Conference, Aug. 28–31, 1993; Seattle, Washington; 14 pgs.

Waterjet Technology, Inc., Flow Technology Report No. 203, Sep. 1981, 1 page.

Stone Age Waterjet Engineering, Schematic Drawing of BJ41 Head, 1 page, Oct. 1995.

Stone Age Waterjet Engineering, Schematic Drawing of SA 03 BQ 0680 Head, 1 page, Jan. 1997.

Stone Age Waterjet Engineering, Schematic Drawing of 18" ϕ Coal Drill Head, 1 page, Jan. 1997.

"Excavating Thin Unminable Coal Seams," John Robinson, pp. 1–13, Apr. 1996.

"Fletcher LHD," Product Brochure, J.H. Fletcher & Co. (undated).

"Borehold (Slurry) Mining of Coal, Uraniferous Sandstone, Oil Sands, and Phosphate Ore," Savanick, George A., *Bureau of Mines Report of Investigations 9101,* 1987.

"Update on Hydraulic Mining in the US," Evers, James L., *Mining Engineering,* Oct. 1984, pp. 1418–1421.

"A review of waterjet excavation research," Summers, David A., *Research & Engineering Applications in Rock Masses*, vol. 2, ed. Ashworth, Eileen; 26th US Symposium on Rock Mechanics (Rapid City, SD), Jun. 26–28, 1985, pp. 895–903.

Model LKD–13 Product Information Sheet, J.H. Fletcher & Co., (undated).

*Novel Drilling Techniques,* Mauer, William, Pergamon Press, 1968, pp. 1–38, 39–44, 94–105.

*Advanced Drilling Techniques,* Mauer, William, Petroleum Publishing Co., 1980, pp. 1–10,28–67,229–405,541–692.

*Waterjetting Technology,* Summers, David, E & FN SPON, 1995, pp. 351–418,506–521,651–656.

"Rotary Drilling Bits," *Chapter 5, Applied Drilling Engineering,* Bourgoyne, Millheim, Chenecert and Young, SPE Textbook Series, vol. 2, 1991.

*SME Mining Engineering Handbook,* vol. 2, Cummins, Given, Society of Mining Engineers of AIME, 1973, §§18–46 to 18–54.

(List continued on next page.)

*Primary Examiner*—David J. Bagnell

*Attorney, Agent, or Firm*—Jenkins & Gilchrist, a Professional Corporation

[57] ABSTRACT

A horizontal remote mining system comprising a water jet cutting head, down hole crusher, jet pump, and guidance system for orchestrating select excavation of a horizontal borehole. The system is assembled on the end of a drill string comprised of multiple compartments accommodating various water pressures and functions in association with the remote excavation process. Selective tubing is also utilized to facilitate movement of air and ventilation of the borehole. In this manner, relatively thin coal seams can be economically mined.

81 Claims, 8 Drawing Sheets

U.S. PATENT DOCUMENTS

| | | | |
|---|---|---|---|
| 2,218,130 | 10/1940 | Court | 15/104.12 |
| 2,518,591 | 8/1950 | Aston et al. | 262/1 |
| 2,720,381 | 10/1955 | Quick | 255/1.8 |
| 2,743,092 | 4/1956 | Funk . | |
| 2,821,374 | 1/1958 | Gardner . | |
| 2,951,680 | 9/1960 | Camp et al. . | |
| 3,041,053 | 6/1962 | Johnson | 299/7 |
| 3,091,439 | 5/1963 | Adams et al. | 299/31 |
| 3,112,800 | 12/1963 | Bobo | 175/67 |
| 3,131,916 | 5/1964 | Adams et al. | 262/26 |
| 3,155,177 | 11/1964 | Fly | 175/67 |
| 3,203,736 | 8/1965 | Andersen | 299/17 |
| 3,236,315 | 2/1966 | Lora | 173/43 |
| 3,251,424 | 5/1966 | Brooks | 175/56 |
| 3,278,236 | 10/1966 | Adams et al. | 299/55 |
| 3,281,187 | 10/1966 | Adams et al. | 299/55 |
| 3,291,534 | 12/1966 | Adams et al. | 299/55 |
| 3,324,957 | 6/1967 | Goodwin et al. | 175/67 |
| 3,331,456 | 7/1967 | Pittman . | |
| 3,346,055 | 10/1967 | Young | 173/37 |
| 3,362,752 | 1/1968 | Densmore | 299/18 |
| 3,385,386 | 5/1968 | Goodwin et al. . | |
| 3,389,759 | 6/1968 | Mori et al. | 175/258 |
| 3,395,940 | 8/1968 | Young et al. | 299/56 |
| 3,395,941 | 8/1968 | Young et al. | 299/90 |
| 3,412,941 | 11/1968 | Steinback | 239/569 |
| 3,414,070 | 12/1968 | Pekarek | 175/393 |
| 3,417,829 | 12/1968 | Acheson et al. | 175/67 |
| 3,424,255 | 1/1969 | Mori et al. | 175/60 |
| 3,435,928 | 4/1969 | Horning | 192/96 |
| 3,439,953 | 4/1969 | Pfefferle | 299/17 |
| 3,455,515 | 7/1969 | Connolly | 241/15 |
| 3,467,436 | 9/1969 | Pentith et al. | 299/31 |
| 3,576,222 | 4/1971 | Acheson et al. | 175/67 |
| 3,592,063 | 7/1971 | Rieschel | 73/406 |
| 3,599,733 | 8/1971 | Varley | 175/61 |
| 3,645,346 | 2/1972 | Miller et al. | 175/237 |
| 3,663,062 | 5/1972 | Young et al. | 299/57 |
| 3,685,865 | 8/1972 | Young | 287/119 |
| 3,698,768 | 10/1972 | Delli-Gatti | 299/55 |
| 3,730,592 | 5/1973 | Wenneborg et al. | 299/17 |
| 3,730,593 | 5/1973 | Karlovsky | 299/76 |
| 3,731,976 | 5/1973 | Granskog et al. | 299/18 |
| 3,743,356 | 7/1973 | Sheets | 299/18 |
| 3,762,532 | 10/1973 | Nelson | 198/117 |
| 3,782,536 | 1/1974 | Toney | 198/233 |
| 3,790,214 | 2/1974 | Kilroy | 299/8 |
| 3,797,590 | 3/1974 | Archibald et al. | 175/213 |
| 3,834,761 | 9/1974 | Ray et al. | 299/10 |
| 3,837,707 | 9/1974 | Kilroy | 299/8 |
| 3,857,490 | 12/1974 | Wilcox | 209/250 |
| 3,858,654 | 1/1975 | Walker | 166/272.6 |
| 3,865,202 | 2/1975 | Takahashi et al. | 175/393 |
| 3,874,733 | 4/1975 | Poundstone et al. | 299/17 |
| 3,881,561 | 5/1975 | Pols et al. | 175/393 |
| 3,887,235 | 6/1975 | Koppers | 299/1.9 |
| 3,897,976 | 8/1975 | Gallis | 299/56 |
| 3,900,226 | 8/1975 | de Jong | 299/17 |
| 3,912,025 | 10/1975 | Deeter et al. | 175/91 |
| 3,922,016 | 11/1975 | Tyslauk et al. | 299/31 |
| 3,924,895 | 12/1975 | Leasure | 299/8 |
| 3,929,378 | 12/1975 | Frenyo et al. | 299/64 |
| 3,934,935 | 1/1976 | Lambly et al. | 299/2 |
| 3,937,025 | 2/1976 | Alvarez-Calderon | 405/267 |
| 3,938,600 | 2/1976 | Essmeier | 175/422 |
| 3,951,457 | 4/1976 | Redford | 299/5 |
| 3,957,308 | 5/1976 | Lambly et al. | 299/14 |
| 3,961,772 | 6/1976 | Sweeney | 254/173 R |
| 3,967,909 | 7/1976 | Deeter et al. | 403/322 |
| 3,980,342 | 9/1976 | Dunham | 299/56 |
| 3,982,789 | 9/1976 | Funk | 302/14 |
| 3,993,354 | 11/1976 | Kilroy | 299/19 |
| 3,995,908 | 12/1976 | Razgildeev et al. | 299/56 |
| 3,996,696 | 12/1976 | Davidtz | 47/58 |
| 4,004,737 | 1/1977 | Aker et al. | 239/102 |
| 4,012,076 | 3/1977 | Shoji et al. | 299/17 |
| 4,021,126 | 5/1977 | Deeter et al. | 403/9 |
| 4,023,862 | 5/1977 | Gold | 299/14 |
| 4,035,023 | 7/1977 | Cockrell | 299/17 |
| 4,036,529 | 7/1977 | Hawthorne et al. | 299/19 |
| 4,040,669 | 8/1977 | Franklin | 299/56 |
| 4,045,086 | 8/1977 | Parkes et al. | 299/17 |
| 4,047,761 | 9/1977 | Coupe | 299/64 |
| 4,049,247 | 9/1977 | Stamer et al. | 266/182 |
| 4,056,284 | 11/1977 | Stoltefuss et al. | 299/64 |
| 4,059,166 | 11/1977 | Bunnelle | 175/232 |
| 4,061,398 | 12/1977 | Parkes | 299/17 |
| 4,062,595 | 12/1977 | Roepke et al. | 299/18 |
| 4,068,755 | 1/1978 | Parkes et al. | 198/557 |
| 4,072,015 | 2/1978 | Morrell et al. | 405/289 |
| 4,074,779 | 2/1978 | Cheung et al. | 175/314 |
| 4,074,920 | 2/1978 | Joyce | 299/18 |
| 4,076,311 | 2/1978 | Johns | 299/2 |
| 4,077,481 | 3/1978 | Bunnelle | 175/232 |
| 4,077,671 | 3/1978 | Bunnelle | 299/17 |
| 4,079,999 | 3/1978 | Grimley | 299/17 |
| 4,092,045 | 5/1978 | Sullivan | 299/17 |
| 4,094,157 | 6/1978 | Karsten et al. | 405/303 |
| 4,106,815 | 8/1978 | Dunn | 299/59 |
| 4,118,072 | 10/1978 | Kelley et al. | 299/43 |
| 4,120,535 | 10/1978 | Delli-Gatti, Jr. | 299/18 |
| 4,129,335 | 12/1978 | Lavon et al. | 299/17 |
| 4,133,582 | 1/1979 | Kogelmann | 299/64 |
| 4,159,149 | 6/1979 | Castanoli | 299/80 |
| 4,159,852 | 7/1979 | Montgomery | 299/56 |
| 4,160,566 | 7/1979 | McGee et al. | 299/30 |
| 4,160,619 | 7/1979 | Nelson | 414/501 |
| 4,185,706 | 1/1980 | Baker, III et al. | 175/340 |
| 4,189,184 | 2/1980 | Green | 299/8 |
| 4,193,635 | 3/1980 | Thiruvengadam et al. | 299/17 |
| 4,199,192 | 4/1980 | Odinokov et al. | 299/17 |
| 4,204,715 | 5/1980 | Lavon | 299/16 |
| 4,205,881 | 6/1980 | Nitzberg | 299/18 |
| 4,212,353 | 7/1980 | Hall | 166/303 |
| 4,222,612 | 9/1980 | Kostovetsky et al. | 299/11 |
| 4,243,268 | 1/1981 | Löbble et al. | 299/32 |
| 4,262,757 | 4/1981 | Johnson, Jr. et al. | 175/67 |
| 4,264,106 | 4/1981 | Deeter et al. | 299/56 |
| 4,265,487 | 5/1981 | Barker | 299/34 |
| 4,277,105 | 7/1981 | Taylor | 299/64 |
| 4,280,735 | 7/1981 | Löbbe | 299/81 |
| 4,285,409 | 8/1981 | Allen | 175/336 |
| 4,289,354 | 9/1981 | Zakiewicz | 299/4 |
| 4,296,824 | 10/1981 | Kennington | 175/340 |
| 4,296,970 | 10/1981 | Hodges | 299/67 |
| 4,301,731 | 11/1981 | Fitzgerald | 102/330 |
| 4,301,875 | 11/1981 | Munding et al. | 175/12 |
| 4,302,052 | 11/1981 | Fischer | 299/67 |
| 4,304,308 | 12/1981 | Munding et al. | 175/12 |
| 4,306,627 | 12/1981 | Cheung et al. | 175/422 |
| 4,309,059 | 1/1982 | Walsh | 299/11 |
| 4,314,730 | 2/1982 | Plumpton et al. | 299/75 |
| 4,332,317 | 6/1982 | Bahre et al. | 198/734 |
| 4,342,425 | 8/1982 | Vickers | 239/424 |
| 4,348,058 | 9/1982 | Coakley et al. | 299/17 |
| 4,350,392 | 9/1982 | Wild | 299/13 |
| 4,366,988 | 1/1983 | Bodine | 299/14 |
| 4,367,902 | 1/1983 | Schwarting et al. | 299/42 |
| 4,377,311 | 3/1983 | Seller | 299/75 |
| 4,387,798 | 6/1983 | Jamison et al. | 198/587 |
| 4,391,329 | 7/1983 | Gallus | 166/336 |
| 4,391,339 | 7/1983 | Johnson, Jr. et al. | 175/393 |

| | | | |
|---|---|---|---|
| 4,401,345 | 8/1983 | Archibald | 299/64 |
| 4,405,176 | 9/1983 | Hodges | 299/17 |
| 4,415,206 | 11/1983 | Hodges | 299/17 |
| 4,420,187 | 12/1983 | Hodges | 299/17 |
| 4,437,706 | 3/1984 | Johnson | 299/7 |
| 4,440,450 | 4/1984 | Coakley | 299/17 |
| 4,443,016 | 4/1984 | Schungel | 277/73 |
| 4,451,089 | 5/1984 | Paurat et al. | 299/43 |
| 4,452,491 | 6/1984 | Seglin et al. | 299/5 |
| 4,494,618 | 1/1985 | Radtke | 175/393 |
| 4,508,389 | 4/1985 | Hodges | 299/17 |
| 4,511,290 | 4/1985 | Lubojatzki | 405/292 |
| 4,524,859 | 6/1985 | Gotte et al. | 198/735 |
| 4,527,836 | 7/1985 | Uhri | 299/17 |
| 4,531,592 | 7/1985 | Hayatdavoudi | 175/67 |
| 4,534,427 | 8/1985 | Wang et al. | 175/67 |
| 4,536,035 | 8/1985 | Huffman et al. | 299/17 |
| 4,542,798 | 9/1985 | Madigan | 175/340 |
| 4,550,952 | 11/1985 | Hall | 299/64 |
| 4,552,038 | 11/1985 | Heiermann et al. | 81/57.38 |
| 4,556,256 | 12/1985 | Follert et al. | 299/33 |
| 4,557,635 | 12/1985 | Watermann et al. | 405/296 |
| 4,575,155 | 3/1986 | Hodges | 299/17 |
| 4,583,784 | 4/1986 | Uhri | 299/11 |
| 4,589,700 | 5/1986 | Schroder | 299/18 |
| 4,615,564 | 10/1986 | Garrett | 299/7 |
| 4,624,327 | 11/1986 | Reichman | 175/67 |
| 4,626,031 | 12/1986 | Nemeth et al. | 299/16 |
| 4,637,657 | 1/1987 | Snyder | 299/31 |
| 4,641,889 | 2/1987 | Brandl | 299/75 |
| 4,647,112 | 3/1987 | Demoulin et al. . | |
| 4,648,753 | 3/1987 | Stephan | 405/260 |
| 4,666,347 | 5/1987 | Janssen | 406/144 |
| 4,669,674 | 6/1987 | Oldengott et al. | 241/101.7 |
| 4,679,856 | 7/1987 | Lubojatsky et al. | 299/11 |
| 4,687,066 | 8/1987 | Evans | 175/340 |
| 4,707,162 | 11/1987 | Brookes | 44/51 |
| 4,708,395 | 11/1987 | Petry et al. | 299/17 |
| 4,708,396 | 11/1987 | Nowak . | |
| 4,718,728 | 1/1988 | Hodges | 299/17 |
| 4,721,201 | 1/1988 | Oldengott et al. | 198/535 |
| 4,721,340 | 1/1988 | Wrulich et al. . | |
| 4,723,612 | 2/1988 | Hicks | 175/393 |
| 4,728,152 | 3/1988 | Pike et al. | 299/17 |
| 4,733,735 | 3/1988 | Barr et al. | 175/393 |
| 4,733,914 | 3/1988 | Kogelmann . | |
| 4,749,311 | 6/1988 | Watermann et al. | 405/290 |
| 4,755,002 | 7/1988 | Parrott . | |
| 4,759,415 | 7/1988 | Pessier | 175/340 |
| 4,764,434 | 8/1988 | Aronsson et al. | 428/565 |
| 4,765,686 | 8/1988 | Adams . | |
| 4,768,836 | 9/1988 | Nowak . | |
| 4,770,469 | 9/1988 | Schellenberg et al. . | |
| 4,773,528 | 9/1988 | Anderson et al. | 198/861.2 |
| 4,773,795 | 9/1988 | Watermann et al. | 405/293 |
| 4,784,257 | 11/1988 | Doerr | 198/594 |
| 4,784,439 | 11/1988 | Wrulich et al. | 299/57 |
| 4,787,465 | 11/1988 | Dickinson, III et al. | 175/67 |
| 4,792,282 | 12/1988 | Jordan | 416/176 |
| 4,826,087 | 5/1989 | Chinery | 239/551 |
| 4,844,238 | 7/1989 | Lachner | 198/861.2 |
| 4,848,844 | 7/1989 | Weiss | 299/55 |
| 4,852,947 | 8/1989 | Jones . | |
| 4,854,091 | 8/1989 | Hashish et al. | 51/439 |
| 4,865,185 | 9/1989 | Bodimer | 198/861.2 |
| 4,878,712 | 11/1989 | Wang | 299/10 |
| 4,881,691 | 11/1989 | Oldengott et al. | 241/101.5 |
| 4,884,847 | 12/1989 | Bessinger et al. . | |
| 4,886,131 | 12/1989 | Cholet et al. | 175/340 |
| 4,915,452 | 4/1990 | Dibble | 299/17 |
| 4,921,057 | 5/1990 | Smet | 175/203 |
| 4,934,466 | 6/1990 | Paveliev et al. | 175/102 |
| 4,946,316 | 8/1990 | Watermann et al. | 405/302 |
| 4,946,597 | 8/1990 | Sury | 210/705 |
| 4,957,327 | 9/1990 | Oppenlander et al. | 299/11 |
| 4,957,405 | 9/1990 | Roberts et al. | 414/339 |
| 4,969,691 | 11/1990 | Moore et al. | 299/18 |
| 5,030,054 | 7/1991 | Reschly et al. | 414/174 |
| 5,069,328 | 12/1991 | Schupphaus et al. | 198/731 |
| 5,096,048 | 3/1992 | Lachner et al. | 198/733 |
| 5,098,164 | 3/1992 | Savanick et al. | 299/17 |
| 5,112,111 | 5/1992 | Addington et al. | 299/18 |
| 5,127,710 | 7/1992 | Babichev et al. | 299/17 |
| 5,129,502 | 7/1992 | Justice | 198/303 |
| 5,161,744 | 11/1992 | Schoop et al. | 241/101.7 |
| 5,178,223 | 1/1993 | Smet | 175/424 |
| 5,197,783 | 3/1993 | Theimer et al. | 299/17 |
| 5,217,163 | 6/1993 | Henshaw | 239/101 |
| 5,232,269 | 8/1993 | Addington et al. | 299/67 |
| 5,234,257 | 8/1993 | Sugden et al. | 299/10 |
| 5,261,729 | 11/1993 | Addington et al. | 299/64 |
| 5,263,421 | 11/1993 | Lichty et al. | 105/248 |
| 5,297,639 | 3/1994 | Schneider et al. | 175/65 |
| 5,308,196 | 5/1994 | Frederick | 405/288 |
| 5,330,257 | 7/1994 | Wurster | 299/56 |
| 5,348,130 | 9/1994 | Thomas | 198/312 |
| 5,364,171 | 11/1994 | Addington et al. | 299/18 |
| 5,427,439 | 6/1995 | Herickhoff | 299/64 |
| 5,435,628 | 7/1995 | Montgomery et al. | 299/17 |
| 5,513,728 | 5/1996 | Alberni et al. | 188/71.7 |
| 5,513,902 | 5/1996 | Pago et al. | 299/1.6 |
| 5,553,926 | 9/1996 | Blackstock et al. | 299/10 |
| 5,632,349 | 5/1997 | Dove et al. | 175/393 |
| 5,634,545 | 6/1997 | Plumley | 198/303 |
| 5,667,279 | 9/1997 | Christopher et al. | 299/1.9 |
| 5,673,974 | 10/1997 | Lammer et al. | 299/12 |
| 5,709,433 | 1/1998 | Christopher et al. | 299/30 |

OTHER PUBLICATIONS

*SME Mining Engineering Handbook,* 2nd Ed., vol. 2, Hartman, Howard L. Ed., Society for Mining, Metallurgy, and Exploration, Inc., 1992, pp. 1447–1452.

*Introductory Mining Engineering,* Hartman, L., John Wiley & Sons, pp. 207–212 (undated).

*Methods of Working Coal and Metal Mines,* vol. 3, Woodruff, Seth D., Pergamon Press, pp. 124–128 (undated).

*Coal Mining Technology, Theory and Practice,* Stefanko, Robert, Society of Mining Engineers of the American Institute of Mining, Metallurgical, and Petroleum Engineers, Inc. 1983, pp. 311–312.

"The Borehole Slurry Pump Crusher," Product Brochure, Flow Industries, Inc., 21414 68th Avenue South, Kent, Washington 98031 (undated).

HORIZONTAL REMOTE MINING SYSTEM, AND METHOD

BACKGROUND OF THE INVENTION

1. Field of the Invention

The present invention is related to drilling and mining processes and, more particularly, but not by way of limitation, to a mining system incorporating hydraulic, borehole mining techniques particularly adapted for the recovery of coal from relatively thin coal seams.

2. History of Related Art

The recovery of coal from coal seams has been the subject of technical development for centuries. Among the more conventional mining techniques, hydraulic mining systems have found certain industry acceptance. Hydraulic mining typically utilizes high pressure water jets to disintegrate material existing in strata or seams generally disposed overhead of the water jets. The dislodged material is permitted to fall to the floor of the mining area and is transported to the mining surface via gravity and/or water in a flume or slurry pipeline. Along these lines, certain developments in Russia included a series of hydro monitors capable of extracting a strip of coal 3 feet wide and 30 to 40 feet in depth within a matter of minutes. The units were designed to be conveyed on a track to the advancing coal face for extracting the coal. The coal would flow downwardly and be transported to the surface via a flume. Similar techniques to this have found commercial acceptance in China, Canada, and Poland, but with only limited attempts in the United States.

Although not as widely accepted in the United States, hydraulic mining methods have been the subject of numerous U.S. patents. U.S. Pat. No. 3,203,736 to Anderson describes a hydraulic method of mining coal employing hydraulic jets of water of unusually small diameter to cut the coal. Such techniques would be particularly applicable to steeply dipping coal seams. Likewise, U.S. Pat. No. 4,536,052 Huffman describes a hydraulic mining method permitting coal removal from a steeply dipping coal seam by utilizing a vertical well drilled at the lowest point of the proposed excavation. Another slant borehole is drilled at the bottom of the coal seam to intersect with the vertical well. High pressure water jets are then used to disintegrate the coal in a methodical fashion with the resulting slurry flowing along the slant borehole into the vertical well. Once in the well, this coal slurry could be pumped to the surface of the mine. While effective in steeply dipping coal seams where gravity would allow the slurry to flow to the vertical well, other techniques would be necessary for more horizontal mining systems. Additionally, U.S. Pat. No. 4,878,712 to Wang teaches the use of water jets to remove horizontal slices of coal within a seam. Through the sequential mining of layers in this manner from top to bottom, the entire seam of coal can be extracted and the mine roof subsides onto the floor without need for artificial roof support.

Another technique for extracting minerals from subterranean deposits is the above referenced borehole mining. Such techniques create minimal disturbance at the mining surface while water jets are used to cut or erode the pay zone and create a slurry down hole. A sump is created below the pay zone to collect the produced cuttings and slurry, which is transported to the surface via a jet or slurry pump. A wide variety of minerals, primarily soft rock formations, may also be mined utilizing this technique. A more recent borehole mining technique is described in U.S. Pat. No. 3,155,177 to Fly wherein a process for under reaming a vertical well and a hydrocarbon reservoir is shown. The technique illustrated therein utilizes electric motors to convert the apparatus from drilling to under reaming.

More conventional techniques are seen in U.S. Pat. Nos. 4,077,671 and 4,077,481 to Bunnelle which describe methods of and apparatus for drilling and slurry mining with the same tool. A related borehole mining technique is shown in U.S. Pat. No. 3,797,590 to Archibald which teaches the concept of completely drilling the vertical well through the portion of the strata to be mined. Separate lines are used for water jet cutting and slurry removal. A progressive cavity pump is used to transport slurry to the surface. In the later improvement (U.S. Pat. No. 4,401,345) the cutting tool is moved independently from the pumping unit. Later developments are shown in U.S. Pat. No. 4,296,970 which describes the use of various types of rock crushers at the inlet of the jet pump. A feed screw on the bottom of the drill string is used to meter the flow of slurry into the orifice of a venturi in association with the rock crusher. In a subsequent development (U.S. Pat. No. 4,718,728), it is suggested to use a tri-cone bit assembly on the end of the tool to reduce the particle size to allow slurry transport. In U.S. Pat. No. 5,197,783 an extensible arm assembly is incorporated to allow the water jet cutting mechanism to extend outwardly from the borehole mining tool to provide more effective cutting in the water filled cavity.

Complementing some mining techniques is the J. H. Fletcher & Co. Model LHD-13 long hole drill unit. This unit consists of a drilling system disposed upon a four wheeled tender car having a drill boom and carriage. Roof jacks are also included and the system is generally used to install in-mine methane drainage boreholes in advance of gassy coal mines.

The above described mining techniques present methods of and apparatus for mineral excavation for sites with specific geological characteristics. In the main such characteristics include steeply dipping coal seams and/or gravity to facilitate transport of the coal to the surface. Transport of the coal, however, is not the only design problem. The distance between the cutting face and the water jet unit increases as material is eroded away. Cutting effectiveness therefore decreases until the unit is moved. These specific design points have been referred to above and are areas of continued technical development. This is particularly true due to the fact that in borehole mining, cutting effectiveness of the water jets also decreases as the cavity becomes larger in size. When the cavity reaches a point that cutting effectiveness diminishes, either another vertical well must be installed to initiate another cavity or the cutting unit needs to be moved closer to the coal face. Also, when a cavity is created in unconsolidated material, subsidence may be created and the cavity may collapse. Borehole mining is, therefore, referred to as a selective mining technique and may not always be suitable for low cost extraction on a large scale basis. Borehole mining is also generally constrained by the ability to remove material from the sump as described above. It would be an advantage therefore to overcome the problems of the prior art by providing a system for horizontal remote mining capable of addressing low cost and effective mineral excavation while effectively utilizing cutting techniques that are consistent with material removal methods therewith.

The present invention provides such an advance over the prior art by utilizing a continuously advancing horizontal remote mining unit that may be disposed within a coal seam close to the face of the coal being eroded. In this manner, a horizontal remote mining unit may develop a horizontal in-seam excavation with improved cutting and slurry removal effectiveness.

SUMMARY OF THE INVENTION

The present invention relates to horizontal mining methods for thin seam coal deposits and requisite mining systems therefor. More particularly, the present invention relates to a horizontal remote mining unit comprising a water jet cutting head, down hole crusher, jet pump, and guidance system for orchestrating select excavation of a borehole or tunnel. The terms "tunnel" and "borehole" will be used interchangeably hereafter when referring to the methods of and apparatus for the present invention. The unit will be assembled on the end of a drill string comprised of multiple compartments accommodating various water pressures and functions in association with the remote excavation process. Selective tubing may also be utilized to facilitate movement of air and ventilation of the borehole in the event an accumulation of methane gas or the like is encountered. A high pressure water line may also be used to deliver water pressures between 1000 psi and 5000 psi and volumes of 50 to 500 gpm, in accordance with the principles of the present invention.

Another aspect of the above described invention would generate a series of boreholes spaced to allow relatively small pillars between tunnels for creating roof support. Such a method and system could eliminate and/or reduce the need for a conventional roof support systems typical of long wall or room and pillar mining.

In another aspect, the present invention enhances water jet effectiveness under water or in air by keeping the water jet nozzle close to the cutting face at all times. This is accomplished by advancing the water jets via a horizontal drill unit in conjunction with or independent of a hydraulically driven down hole crawler. In certain applications, materials other than coal may be excavated.

In yet another aspect, the above described invention includes a down hole guidance system to maintain alignment of the excavation parallel with the previous borehole and avoid intersection therewith while assisting and maintaining the borehole within the confines of the coal seam. The final borehole diameter would be tailored to the thickness of the coal seam with the borehole drilled as long as practical with an objective length of 1,000 feet. In this manner, rapid penetration rates may be utilized with water jetting systems. In one embodiment, the present invention includes a mechanically assisted cutter head. Coal excavated therewith would be transported to the well head with a jet pump through reverse circulation back through the discharge pipeline. The jet pump would be incorporated in the downhole end of the discharge pipeline to assist in removal of produced coal. The jet pump in conjunction with reverse circulation would allow the use of acceptable water flow rates, pressure and velocity in order to maintain the produced coal and suspension for routing to the well bore or to the mining surface. In one embodiment, the coal would be conveyed to the surface via a belt line or slurry pipeline, with additional coal de-watering and processing conducted on the surface for final coal processing before delivery and sale.

In a further aspect, the present invention comprises a method of horizontal borehole mining of relatively thin seam coal deposits. The method includes the steps of defining an area for horizontal borehole mining and excavating access tunnels therealong and/or therearound. A borehole mining unit is positioned in the access tunnel and generally horizontal boreholes are execavated therefrom. The boreholes are spaced to form roof support webs therebetween. The coal is excavated by a waterjet cutting head and discharged therefrom by a jet pump positioned near the cutting head. In one embodiment the access tunnels are boreholes extending transversely thereacross.

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION

Figure 1:
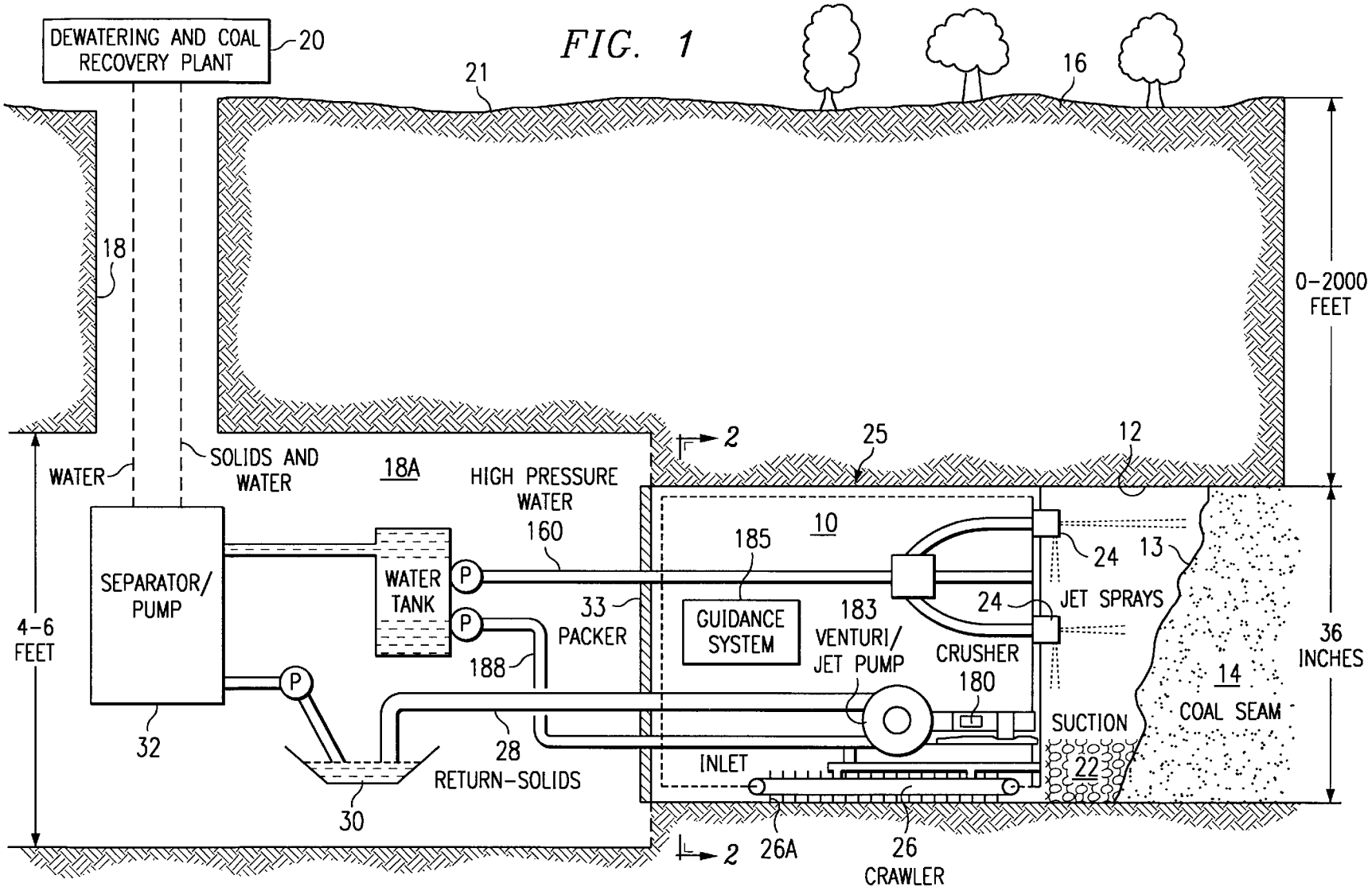
FIG. 1 is a side elevational, cross sectional, diagrammatical view of one embodiment of a mining system utilizing the principles of the present invention.

Referring first to FIG. 1, there is shown a side elevational, cross sectional, diagrammatical view of one embodiment of a mining system utilizing the principles of the present invention. System 10 is shown disposed in a tunnel 12 of a coal seam 14 located beneath layers of earth 16. A vertical shaft 18 connects an above ground dewatering and coal recovery plant 20 on surface 21 to the tunnel 12 which terminates at cutting face 13. Coal 22 is mined from face 13 of seam 14 partially dried at separator/pump 32, and carried to the surface 21 by a network of devices described below. It should be noted that FIG. 1 is only a general schematic. There may be numerous tunnels 12 developed throughout the coal seam 14. There may be limited shafts 18 and access tunnels 18A (described below). The wellhead will be the term that is used to describe the start of each borehole tunnel 12 along the access tunnel 18A. The devices of the present invention thus provide means for mining coal 22 that is not available to conventional mining techniques, because conventional underground and surface highwall coal mining techniques are generally not cost effective for extraction of thin (e.g. less than 36" in diameter) coal seams. The present invention allows the economic extraction of such thin coal seams that could be used on a flat or moderately pitched coal seam. As described below, the system 10 uses water jet nozzles or water jet assisted mechanical techniques to erode the coal face. A down hole crusher 180 is integrated with a jet pump 183, wherein the crusher prevents clogging of coal from the inlet of the jet pump. Coal is then transported to the wellhead via a plastic coal slurry discharge pipeline 28. Packer 33 is an inflatable (with compressed air, water, or other liquid/gas medium) rubber element that enables the downhole portion of tunnel 12 to be isolated from the pumps, drill unit, and manpower working area. Isolation of the working face allows a differential pressure to be created which may facilitate removal of coal 22 out of the borehole. These aspects and others will now be set forth with the degree of specificity deemed necessary for those skilled in the art.

Referring still to FIG. 1, the system 10 includes a hydraulic cutting head 24, such as a water jet assembly mounted upon a moveable frame or crawler 26. the crawler 26 allows the cutting head 24 to advance into seam 14 at the end of a drill string 25 which includes the discharge pipeline 28, high pressure waterline 160, and jet pump pipeline 188. A discharge pipeline 28 is also mounted to the crawler 26 for carrying removed coal 22 and liquid back through tunnel 12 to a collection trough 30, wherein the coal 22 may be collected and returned to the surface 21.

The present invention thus presents a horizontal remote mining system utilizing waterjet drilling. Waterjets without the aid of mechanical cutting devices are very useful for drilling into coal. This is because of the relative ease with which water can cut coal, in contrast to other, harder rocks. It is well known that in coal, the ability of the waterjet to cut at a considerable distance from the nozzle and to drill holes of relatively large diameter is enhanced because of the unique structure of the coal. Waterjets take advantage of the face and butt cleats and its weakness in tension. The result is that water jets can cut and move large volumes of coal with little effort. Furthermore, tailoring the cutting pressures may allow the selective extraction of coal and not roof or floor strata. Cutting pressures between 1000 and 5000 psi are currently projected. However, it has been shown through other borehole mining operations that water jets may produce oversized pieces of material. This issue requires a downhole crusher to effectively convey produced material out of the borehole. The water jet nozzles could be positioned offset from the cutting head axis. The cutting head would be connected to a downhole swivel and allow rotation of the cutting head downhole and eliminate rotation of the drill string. Dual compartment drill strings have also been used for both cutting and coal transportation out of a borehole. The primary problem encountered in certain of those studies was removing cuttings. For this reason, augers have been tested to convey the coal out of the borehole. Additionally, systems have been developed by others for specialized applications, including (1) drilling small diameter boreholes in advance of mining for exploration and methane drainage and (2)retro jets to assist drill rods in penetrating small diameter boreholes. For these reasons, the present invention utilizes the advantages of many of these types of systems and new innovations in a system 10 specifically adapted for remote penetration through a horizontal coal seam 14.

Figure 2A:
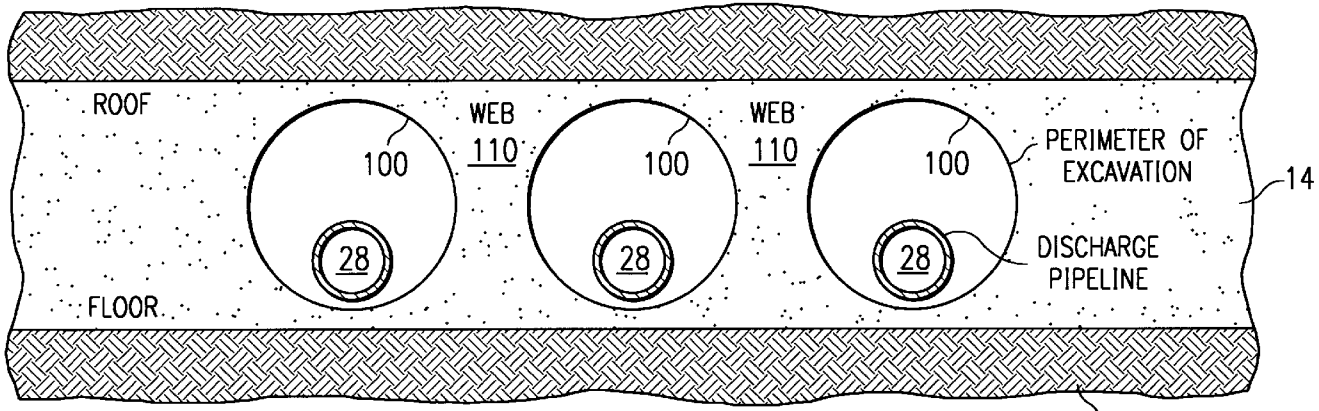
FIG. 2A and 2B are front elevational, diagrammatical, cross sectional views of excavation configurations utilizing the system of FIG. 1 and taken along lines 2—2 thereof.
Figure 2B:
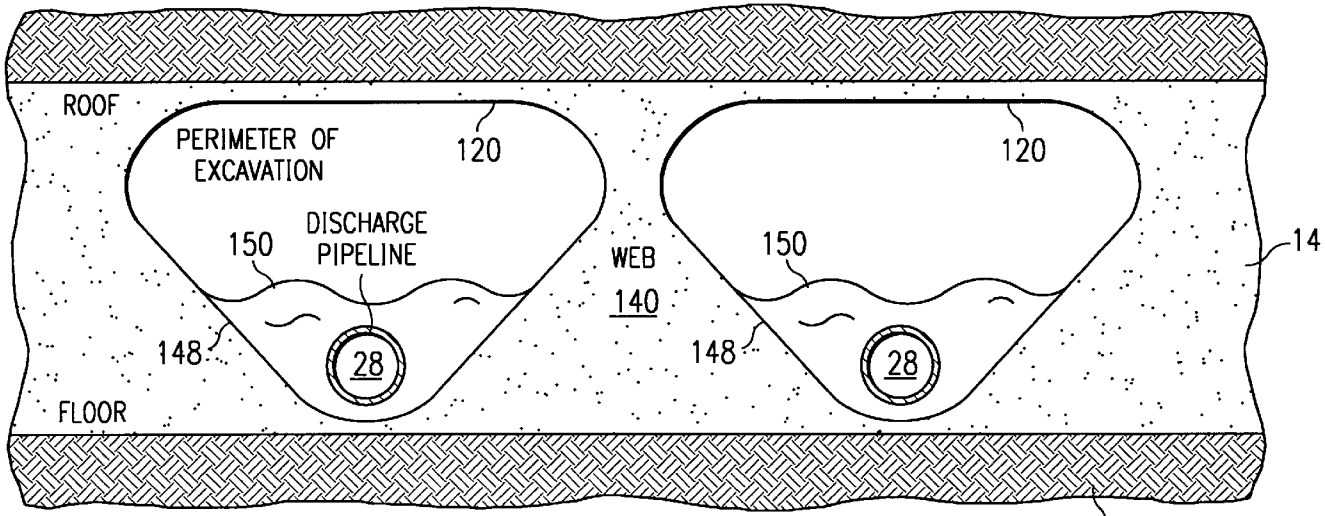

Referring now to FIGS. 2A and 2B, there are shown front elevational, diagrammatical, cross-sectional views of excavation configurations. The views are taken along lines 2—2 shown in FIG. 1. What is shown in FIG. 2A is a series of circle shaped excavations 100 formed in a coal seam 14 of earth section 16. The excavations 100 are each separated by webs 110 of coal that are left to provide roof support. The discharge pipeline 28 is also shown for reference purposes.

FIG. 2B illustrates an alternative embodiment of an excavation configuration depicting pie shaped excavations 120 formed in coal seam 14 of earth section 16. A "pie" shaped excavation 120 would not likely allow rotation of the entire cutting head 24 but would facilitate coal removal from the borehole. A shield, described below, would be used in conjunction with a protruding pipe in both round and pie shaped tunnels 12 to prevent inadvertent advancement of the horizontal remote mining unit 10 into the face faster than it is cut. A web 140 is again left for structural reasons. This figure also illustrates the discharge pipeline 28 disposed in lower sections 148 of excavation 120. In this particular embodiment, water 150 may be incorporated for lubricating, floating or otherwise facilitating the movement of a frame such as the crawler 26 of FIG. 1.

Figure 3:
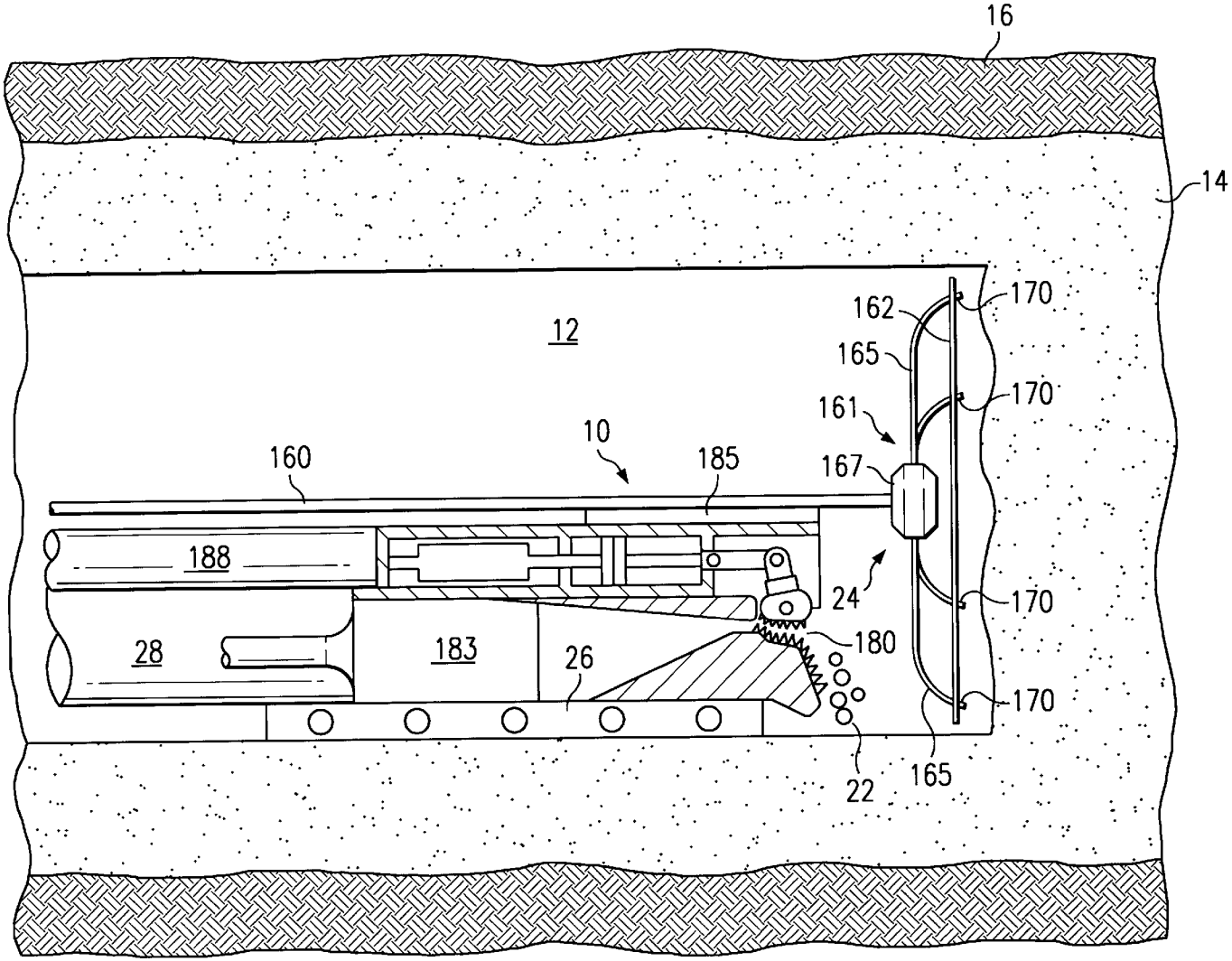
FIG. 3 is a side elevational, cross sectional, diagrammatical view of one embodiment of the system of FIG. 1.
Figure 5A:
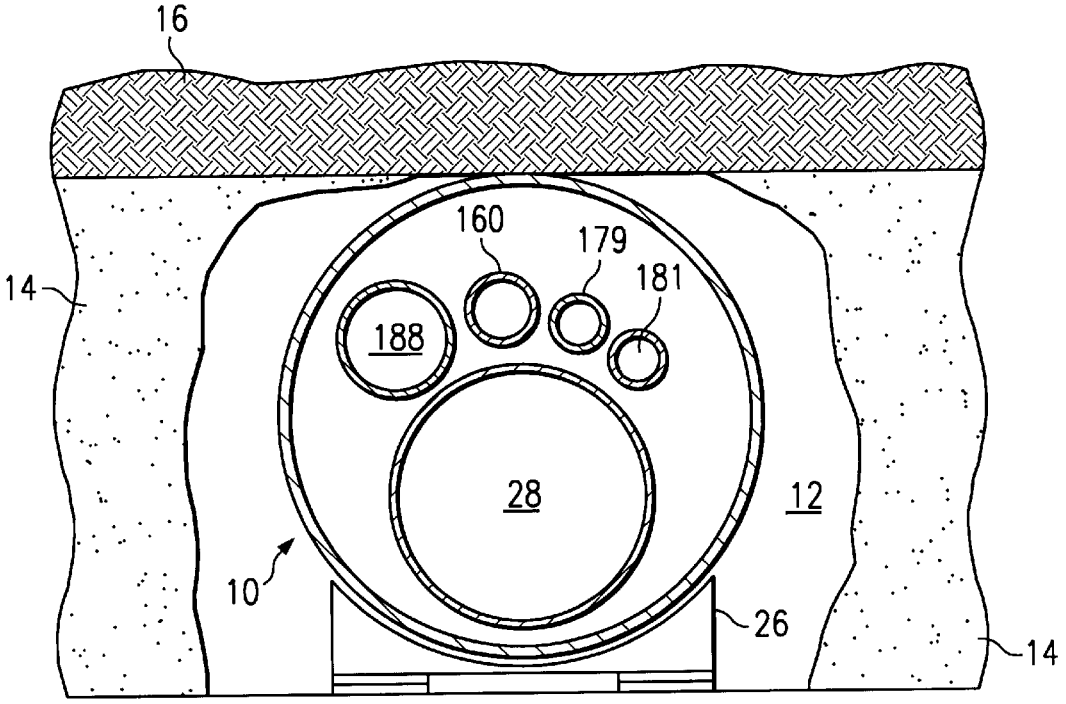
FIGS. 5A and 5B are front elevational, diagrammatical, cross sectional views of pipeline configurations for the system of FIG. 1.
Figure 5B:
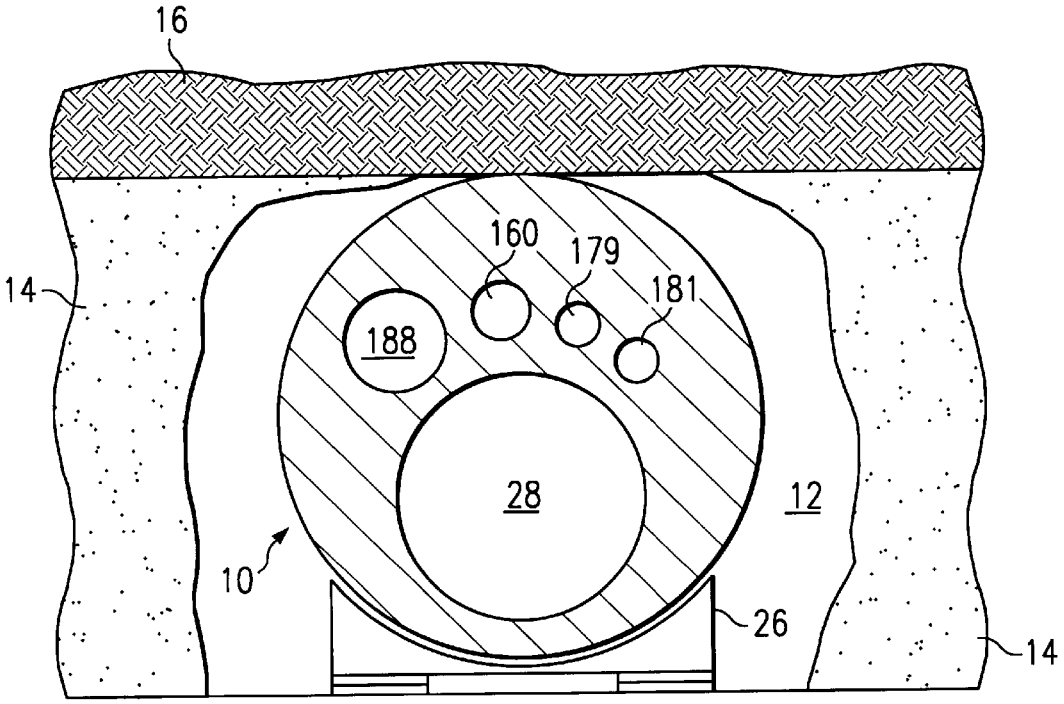

Referring now to FIG. 3, there is shown a side elevational, cross sectional, partial, diagrammatical view of one embodiment of the system 10 of FIG. 1. High pressure water is routed to the cutting head via a high pressure water hose 160. The cutting head 24 comprises a high pressure water jet nozzle assembly 161 protected by a shield 162. High pressure steel pipes 165 emanate out of a nozzle head 167 to distribute high pressure water to the water jet nozzles 170 distributed across the cutting face. The coal face is cut by the rotating water jets which may be assembled in a configuration slightly offset from the axis of the cutting head to induce torque. The cutting head 24 may be connected to a swivel in nozzle head 167. Alternatively, a rigid drill string may be rotated by the drill unit. The cut coal 22 falls to the floor and is directed into a down hole crusher 180 where oversized pieces are reduced to a manageable size. Suction is created by a jet pump 183 which conveys coal into the discharge pipeline 28. A guidance system 185 may be provided to provide survey data to allow directional control of the borehole and avoid intersection of adjacent boreholes. The cutting head 24 continues to advance horizontally into the coal face through the progression of the down hole crawler 26 that pulls the discharge pipeline 28 operated in conjunction with a long hole directional drill that would push the down hole tools. Not shown for clarity are the side portions of the crawler 26, as seen in FIG. 5A and 5B, that will preferably be formed to curve up on each side of system 10. Attached to these sides of the crawler will be flexible stainless steel straps to secure system 10.

Still referring to FIG. 3, several operational aspects are herewith addressed. The downhole crushers are preferably hydraulically driven to break up oversized cuttings of coal 22 to prevent blockage of the jet pump inlet. The jet pump 183 is a device in which a jet of fluid (in this case, water) is used to move more fluid. The principle is fluid dynamics. The jet pump preferably has no moving parts. The water jet creates a differential pressure at the inlet by directing a high pressure stream of water through an eductor which is connected to the downhole crusher 180 at the inlet and to the discharge pipeline 28 at the outlet. Water and coal production are drawn into the crusher 180 and accelerated into the discharge pipe 28 by the high velocity water stream. It is projected that each crusher 180 may require 5–100 gpm @ 100–500 psi. The jet pump(s) 183 may require 100–1000 gpm @ 100–500 psi.

Figure 4:
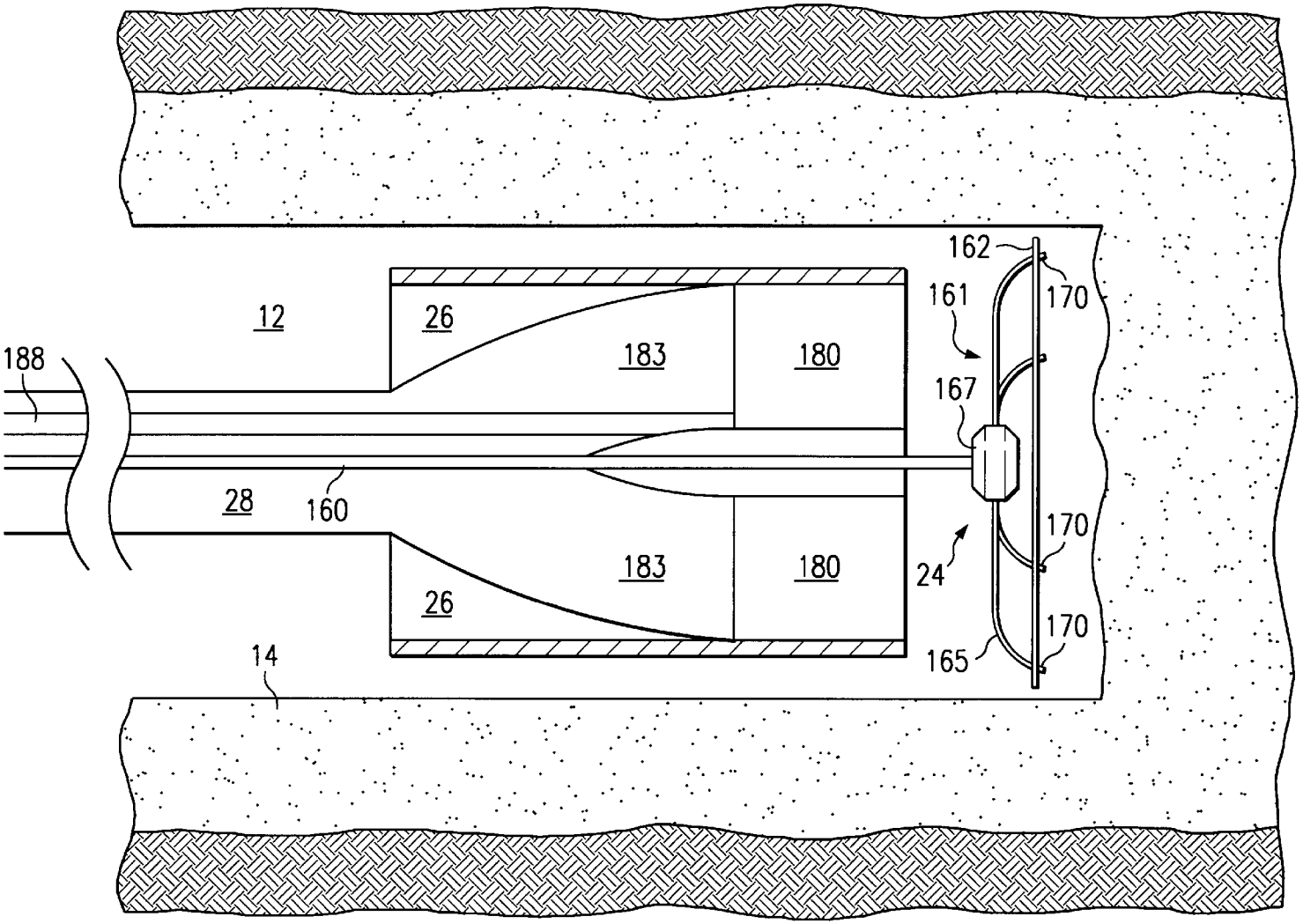
FIG. 4 is a top plan, cross sectional, diagrammatical view of the system of FIG. 1.

Referring now to FIG. 4, there is shown a top plan, cross sectional, diagrammatical view of one embodiment of the system of FIG. 1. It may be seen that the cutting head 24 is positioned in front of a pair of downhole crushers 180 configured in flow communication with jet pumps 183. Both jet pumps 183 are fed by a common water line 188 and then feed a common discharge pipeline 28. High pressure water hose 160 is shown delivering water to the water jet nozzle assembly 161 protected by shield 162. The nozzle head 167 preferably integrates a swivel assembly to allow the high pressure water hose 160 to remain stationary and rotate the cutting head 24 as appropriate.

Referring now to FIGS. 5A and 5B, there are shown elevational views of a diagrammatical type of the drill string 25 and pipeline configurations taken from the front or beginning, of the tunnel 12 looking therein. This view is also taken in cross-section illustrating the coal seam 14 and earth 16. For purposes of clarity in this diagrammatical representation, many of the other elements of the system 10 are not shown. What is shown is a cross sectional view of the pipelines, hoses, and crawler 26 that will be used for the system 10. FIG. 5A shows that each of the lines can be installed separately and independently. The largest diameter pipe is the discharge pipeline 28. The discharge pipeline transports produced coal from the cutting face to the wellbore in slurry form. The jet pump water line 188 provides water at sufficient flow and pressure to activate the jet pumps 183 to induce a suction on the downhole crusher 180 (both shown in FIG. 4) at the cutting face 13. The high pressure water line 160 provides water to the water jet nozzles 170 (FIG. 3) to erode the coal from the face 13. System 10 preferably includes intake line 179 and return line 181 comprising ventilation lines for basic ventilation at the face 13 during development of the tunnel 12. Fresh air is forced down the intake line 179 and sweeps and dilutes any gas accumulation and is routed out of the borehole through the return ventilation line 181.

Figure 6:
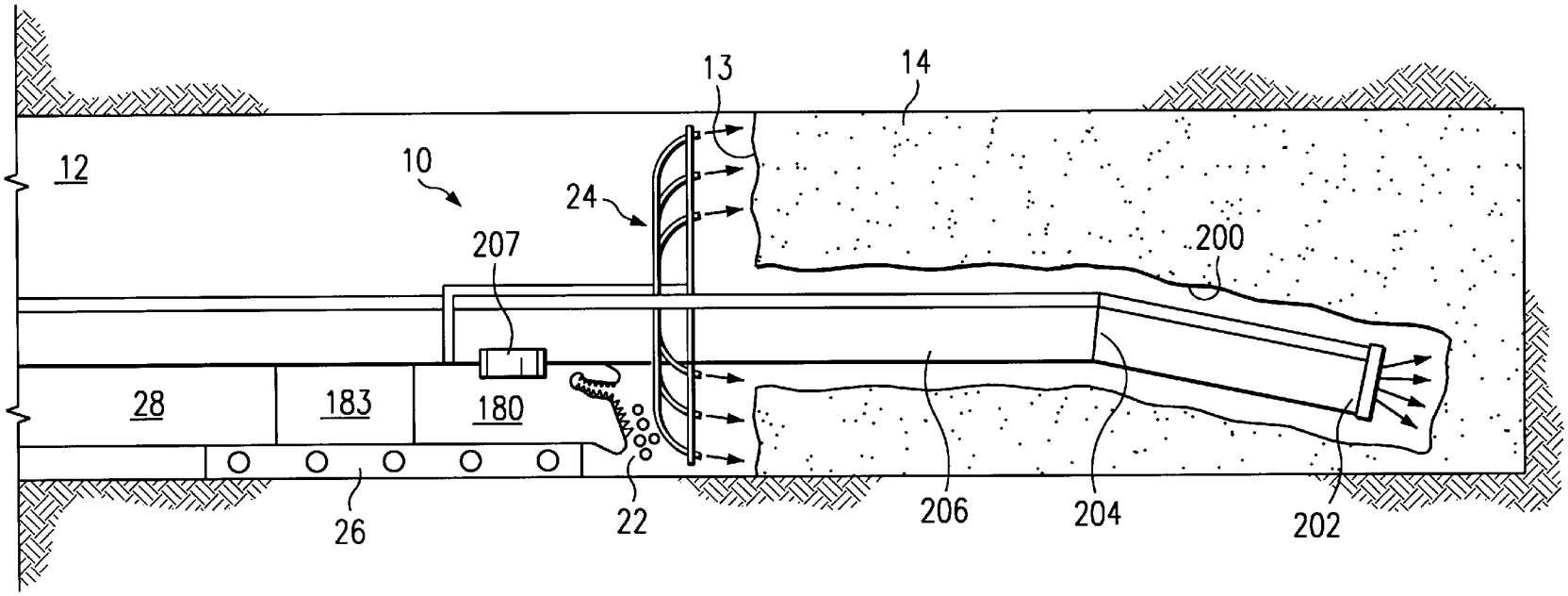
FIG. 6 is a side elevational, cross sectional, diagrammatical view of an alternative embodiment of the system of FIG. 1.

Referring now to FIG. 6, there is shown a side elevational, cross sectional diagrammatical view of an alternative embodiment of the system 10 of FIG. 1. In this view, a pilot borehole 200 is formed by a water jet downhole motor 202. A bent housing 204 is shown connected to a steering tool 206 extending in seam 14. In one embodiment, water jet cutting head 24 is mounted on a crusher 180, and the bent housing 204 is rotationally mounted to the crusher 180 on a bearing means 207. A water jetcutting head 24 is schematically shown eroding face 13 of seam 14. The eroded coal 22 is then flushed by water into the crusher 180, which is connected to a jet pump 183. Crawler 26 advances the system 10 forward to keep close to the eroding face 13. The water and coal 22 forms a slurry which is carried out the tunnel 12 by return pipe 28.

Still referring to FIG. 6, the borehole 200 is directionally drilled and required to maintain the borehole within the coal seam. However, cutting pressures may be able to be monitored to cut coal and not rock. This design would build on previous efforts by University of Missouri and University of Queensland by including a steering tool, reaming device, and address coal removal through a jet pump, coal crusher and reverse circulation. The borehole 200 is directionally drilled with small diameter, downhole motor 202 in conjunction with bent housing 204 and existing drilling technology used in conventional directionally drilled horizontal boreholes. Steering of the pilot borehole would be accomplished with a real time measurement while drilling ("MWD") steering tool 206 located in the drill string behind the small diameter water jetting tool 202. The water jetcutting head 24 would be installed behind the steering tool 206 and enlarge the pilot borehole 200 to the final borehole design for tunnel 12. The pilot borehole 200 drilled to initiate tunnel 12 could be enlarged to create a final excavated area of approximately 10 ft.$^2$. The pilot borehole 200 may be directionally drilled and the reaming by water jet cutting head 24 may be controlled to avoid intersection with the adjacent tunnels shown in FIGS. 2A and 2*b*. The drill string will include a separate external high pressure hydraulic hose for the high pressure (e.g. 5000–10,000 psi) water required for coal cutting and a 6"–8" pipe for coal transport. Using this approach, the system 10 could achieve a coal cutting and removal rate of 40 tph for a single unit operation. This rate is greater than coal removal through many conventional and reverse circulation systems. Conventional circulation of most wells consists of pumping drilling fluid through the drill string and circulating the cuttings up the annulus to the surface. Typically, additives are mixed in the drilling fluid to create a more viscous and higher density drilling fluid to enable the drill cuttings to stay in suspension.

It is known that larger size excavations make it difficult to maintain the required fluid velocity (e.g. 10 fps) to keep cuttings in suspension. As shown in Table 1, calculations were made to estimate the required pump rates to circulate various size cuttings. Conventional circulation will not be practical at these flow rates. Furthermore, a build-up of cuttings in the annulus will cause the rods to stick and potential loss of downhole equipment.

TABLE 1

Conventional Circulation Parameters

| Chip Size (inches) | Slurry Velocity (fps) | Circ. Rate (gpm) | Horsepower (HP) | Oper. Cost ($/day) |
|---|---|---|---|---|
| 1.00 | 20 | 40,000 | 12,000 | 10,800 |
| 0.50 | 10 | 20,000 | 6,000 | 5,400 |
| 0.25 | 5 | 10,000 | 3,000 | 2,700 |
| 0.10 | 2.5 | 5,000 | 1,500 | 1,350 |
| 0.01 | 0.25 | 500 | 750 | 135 |

Reverse Circulation

Coal transported through reverse circulation allows water to be pumped through the annulus and move produced coal back through the drill pipe which offers several advantages as follows:

- Pumping pressures, rates, and resulting horsepower requirements are lower.
- The chances of sticking the drill string and excavating tool are greatly reduced.
- The flow characteristics of the return path can be carefully controlled.
- Water can be used as a transport medium.
- During unexpected shut-down periods the circulating fluid is contained in the excavated area and the excavated material is contained in the drill pipe.
- Cuttings are observed at the well head much more rapidly to verify necessary corrections to stay in the coal seam.

The primary disadvantages of a reverse circulation process are:

- The borehole walls must contain a positive circulating pressure, and a highly fractured or permeable coal seam may allow the positive pressure to leak into the formation.
- A packer or pressure seal must be maintained on the wellhead and allow the discharge pipeline to continue to advance into the tunnel.
- The excavating material must be routed through the crusher and jet pump into the discharge pipeline at an acceptable mass flow rate.

Preliminary calculations were conducted to determine the required circulation rates to transport the coal slurry through reverse circulation. The results are shown in Table 2.

TABLE 2

Circulation Rates for Reverse Circulation

| | 5" ID | | | 6" ID | | | 8" ID | | |
|---|---|---|---|---|---|---|---|---|---|
| ER (tph) | CR (gpm) | vf (fps) | CP (psi) | CR (gpm) | vf (fps) | CP (psi) | CR (gpm) | vf (fps) | CP (psi) |
| 20 | 450 | 7 | 90 | 450 | 5 | 60 | 800 | 5 | 60 |
| 40 | 930 | 15 | 200 | 930 | 10 | 130 | 800 | 6 | 80 |

ER — Excavation rate
CR — Circulation rate
vf — Fluid velocity inside the drill string
CP — Circulating pressure Table 2 indicates that at targeted production rate (40 tons per hour), the water flow in the annulus would need to be ~1000 gpm @ 130 psi for a 6" ID pipeline. This flow rate would move coal production from the water jet cutting head into the discharge pipeline in a slurry to the wellhead. These calculations were based on a particle size of 8 mesh to ¼". Therefore, a discharge pipeline with an internal diameter of at least 6 inches is projected to be required to limit the circulating pressure against the borehole perimeter.

Other calculations have also been made relative to the operation of the system 10. Various diameters and configurations of tunnels 12 have been analyzed to determine the general excavation, size, and penetration rates required per tunnel to achieve reasonable productivity rates for low cost production of coal. For example, Table 3 details tons of coal contained in a 100 foot segment of the tunnel 12 of a given diameter or configuration. These calculations are provided for reference purposes.

TABLE 3

Tons of Coal for Various Borehole Configurations

| Borehole Configuration | Area ($ft^2$) | tons per 100' |
|---|---|---|
| 12" diameter "ϕ" (circle) | 0.79 | 3.2 |
| 24" ϕ (circle) | 3.14 | 12.6 |
| 36" ϕ (circle FIG. 2A) | 7.07 | 28.3 |
| 2' × 6' ϕ (ellipse) | 9.42 | 37.7 |
| 36" ϕ ("pie" FIG. 2B) | 10.21 | 40.8 |

Referring now to FIGS. 1, 3, 4 and 6 in combination, certain components of the system 10 will be discussed for reference purposes. Many borehole excavating tools are commercially available as described in printed publications. Referring first, then, to the cutting head 24, several hydraulic mining systems are shown in U.S. Patents. For example, U.S. Pat. Nos. 1,851,565, 3,155,177 and 4,401,345 disclose hydraulic mining systems employing cutting water jets. Individual elements of the cutting head 24 are also shown in U.S. Pat. No. 3,203,736 which depicts a small diameter water jet to be used to cut coal. Improvements in modern design include flow straighteners and carbide orifices. The shield 162 is preferably a steel plate fabricated with holes cut according to the configuration of the nozzle assembly 161. As described above, the nozzle head 167 would include a swivel which allows rotation of the cutting head as generally described by StoneAge Waterjet Engineering in 1996 Catalog as a SG Rotary Coupling.

As referred to above, the hydraulic downhole crusher 180 reduces the produced coal and rock to a manageable size prior to discharge into the pipeline. Crushers of this general type are described in U.S. Pat. No. 4,296,970 and Flow Industries, Inc. in its catalog as Model SBE-12. Other variations of downhole crushers are described by Flow Industries, Inc. as Models SSE-8, DSE-12, and DSE-18.

As referred to above, the jet pump 183 is integral to operation of the system 10. The jet pump 183 preferably has no moving parts and is adapted to handle coal slurries without difficulty. Such pumps are generally described in U.S. Pat. Nos. 3,155,177 and 4,077,671 and other borehole mining related patents. The jet pump is readily available from industry. Several vendors, including Fox Valve Development Corporation, Pemberthy, Inc., and Schutte & Koerting, provide such pumps.

As referred to above, packer 33 may be required to create a higher differential pressure where system 10 operates relative to the wellhead where the longhole drill and pumps are located. As shown in Table 2, higher downhole pressures will improve reverse circulation production rates. The rubber packer is commonly used in the oil and gas and environmental industries for downhole testing, hydraulic fracturing, zone isolation, etc. and available in various sizes and configurations from Aardvark, Corp. and Tam International, Inc.

As referred to above, control of the drill string and down hole tools may be accomplished from the wellhead through the use of a longhole directional drill. However, it is deemed preferable to push or pull the entire drill string 25 from either end. Therefore the use of a downhole crawler 26 allows pulling of the drill string 25 to advance the cutting head 24 continuously into the coal face 13 as coal 22 is eroded from said face.

During the development of the excavation, or tunnel 12, this down hole crawler 26 would hold the downhole cutting head 24, jet pump 183, crusher 180, and front segment of the discharge pipeline 28. The crawler 26 could use a moving steel track 26A that would be hydraulically driven.

As referred to above, a steering tool 206 may be used. Field experimentation will indicate the level of sophistication that will be required for guidance of the horizontal remote miner of system 10. The basic survey tool is a camera type that takes a picture of a compass at a moment in time. These survey tools are relatively inexpensive and permissible for use in underground coal mines. For example, the Sperry Sun Single Shot and CBC Wellnav Pee Wee are two single shot survey tools that provide inclination, azimuth, and tool orientation. Efficient guidance of the horizontal remote miner may require a cabled tool that would provide continuous reading of surveys or a measurement while drilling ("MWD") survey tool that is wireless and transmits a signal through the formation, drill pipe, or drilling fluid to a receiver on the well head. The term wellhead is referred to herein as that region located at the longhole drill where the borehole 12 initiated. These tools are commonly used in conventional oil and gas industry operations and are available through Halliburton, Schlumberger, Baker Hughes, GeoServices and the like.

As also referred to above, the discharge pipeline 28 is integral to the coal recovery process. The discharge pipeline 28 is preferably lightweight, medium or high density polyethylene pipe of the type commonly used for distribution and transportation of natural gas, liquids and slurry. Likewise, the jet pump water line 188 will likely be of similar construction, including lightweight medium or high density polyethylene pipe. The proposed technique of system 10 requires limited thrust, only to advance the drill string 25 and cutting unit, for penetration. Therefore, lightweight pipe may be used for the drill string 25. Long lengths (e.g., 40–100 feet each) as practical, could be fused to minimize the coupling of joints which slow penetration. The pipe OD may be 6, 8, or 10 inches. Connections between the fused joints may be made with gripper couplings or fused as appropriate. Threaded joints may be used but would require another material such as fiberglass or PVC plastic pipe. The ventilation lines may on the other hand be rubber hose or lightweight medium or high density polyethylene pipe.

Figure 7:
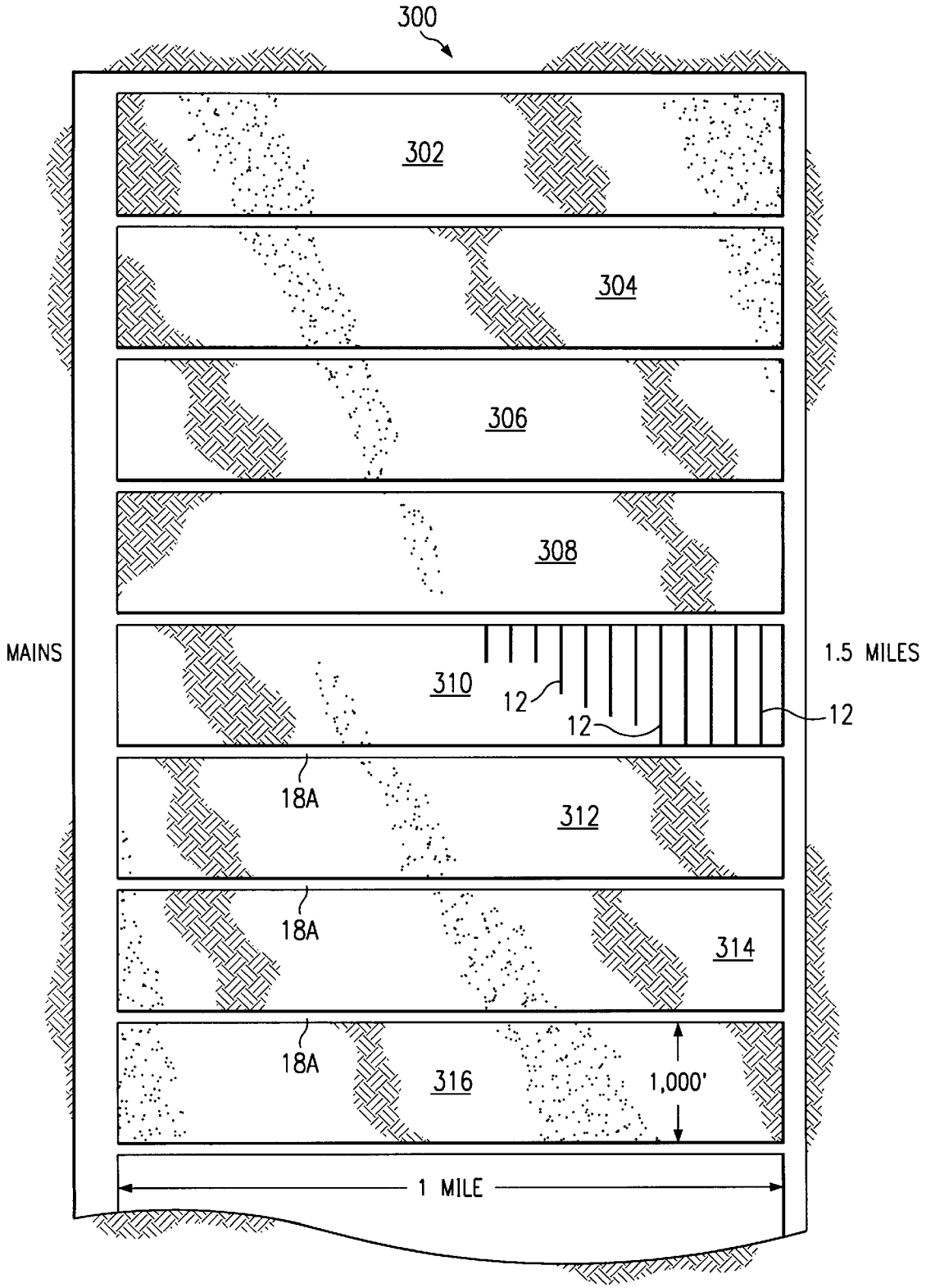
FIG. 7 is a top plan, diagrammatic view of a defined area for the horizontal mining operations of the present invention.

Referring now to FIG. 7, there is shown a top plan, diagrammatic view of a defined area 300 for the horizontal mining operations of the present invention. Area 300 may comprise a mineral deposit of relatively thin proportions, perhaps on the order of 1 to 4 feet in thickness. Minerals such as coal in seams only 1 to 4 feet thick can be difficult to mine in an economical fashion with conventional technology. For that reason, the present invention affords a marked improvement over the prior art.

Referring still to FIG. 7, defined area 300 herein shown comprises a region approximately 1 mile by 1.5 miles in size. This area is preferably only a portion of a larger mineral deposit for which mining is desired. Access tunnels 18A are thus formed therethrough for defining smaller excavation regions 302, 304, 306, 308, 310, 312, 314 and 316, each approximately one mile long and 1000 feet wide. Boreholes 12 are representatively shown formed in region 310 transversely therethrough by the crawler 26 and the remainder of system 10 of the present invention. The access tunnels may be on the order of 15 to 20 feet wide and 3–6 feet high.

Figure 8:
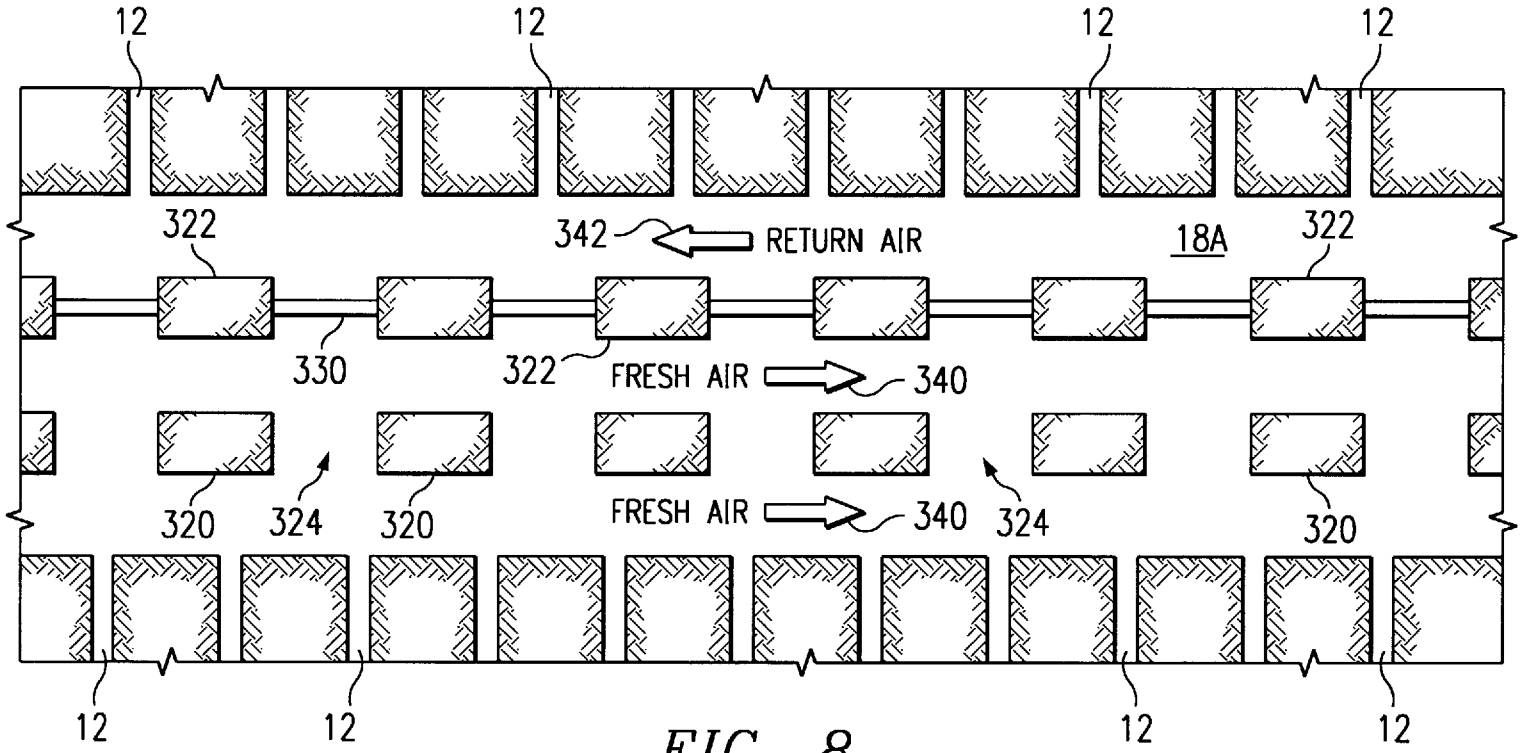
FIG. 8 is an enlarged top plan, diagrammatic view of a portion of the access tunnel 18A.

Referring now to FIG. 8, there is shown an enlarged, diagrammatic top plan view of an area of access tunnel 18A. Said tunnel is shown to be formed with a plurality of coal pillars 320 and 322. The coal pillars 320 and 322 are formed during conventional room and pillar excavation of access tunnel 18A. Pillars 320 have spaces 324 therebetween. Pillars 322 are connected by stoppings 330 constructed therebetween to form a generally solid wall capable of directing and isolating the flow of air for ventilation of boreholes 12. Fresh air 340 is illustrated passing along pillars 320 while return air 342 passes along pillars 322. The wellheads or initiation of boreholes 12 are illustrated as starting from fresh air 340 along access tunnel 18A. The ends of boreholes 12 are illustrated as terminating into access tunnel 18A where return air 342 is routed.

In operation, the system 10 described above may be used to mine coal 22 from coal seams 14 that have heretofore not been economically producible. This may be appreciated by the fact that water jets have already demonstrated the ability for rapid cutting of a coal face. For example, previous surface drilled borehole mining projects have achieved coal cutting rates in excess of 40 tons per hour. However, the ability to: (i) sustain this cutting rate as the cavity is enlarged and (ii) match coal transportation rates out of the hole with coal cutting rates, has not been demonstrated. The present invention addresses these issues by creating a system 10 that uses limited manpower, decreases overall roof support requirements, and may be capable of remote actuation, guidance and control. Cutting head 24 is thus mounted on crawler 26 as described above to permit continuous advancement into the coal seam 14 as the water jets cut coal 22. The crawler 26 is preferably hydraulically driven to pull the drill string that consists of pipes 28, 188, 179 and 181 into the tunnel 12. Another approach is also contemplated by the present invention wherein a drill unit located at the start of the borehole at the wellhead will push the drill string into the excavation. For example, a longhole permissible drill of the type typically used for installation of horizontal methane drainage boreholes could be used. The drill would grip the drill string (primarily 28) and, if rigid, push it into the hole. Such a drill unit would also provide the flexibility of periodic directional drilling of small diameter exploration boreholes along the panel in advance of the horizontal remote mining unit. Either approach would require equipment to be sized to handle the horizontal pushing or pulling of approximately 40,000 pounds which is the anticipated weight of the drill string full of slurry at total depth (e.g. 1000 feet), including the system 10.

Finally, during operation of the system 10 and prior to the installation of a joint of the plastic pipe described above, high pressure water to the cutting head 24 would be stopped to allow the coal slurry in the discharge pipeline 28 to be removed out of the tunnel 12. This step would minimize potential settling of the coal 22 out of the slurry during the adding of sections to the discharge drill pipe 28. Other operational features include the volume of water in the tunnel 12. Although it is unlikely that the entire excavation may be filled with water, there may be a possibility of gas production. Therefore, the drill string 25 includes the ventilation lines described above to remove potential accumulations of methane or other gases. The use of this ventilation system will be determined by site specific geologic and reservoir conditions and by federal regulatory authorities (e.g. Mine Safety and Health Administration "MSHA"). Additionally, a compressed air system for ventilation of the tunnel 12 may be used. An air compressor (not shown) may be installed on the surface 21 and a pipeline system (not shown) may route air to each horizontal remove mining tunnels 12. FIGS. 5A and 5B do show a flexible intake hose 179 will provide fresh air to the cutting face 13. The intake air will dilute any gas to a safe level and will be removed from the excavation through the flexible return hose 181. Each of the hoses may be approximately 2 inches in diameter in order to deliver acceptable air flow, as currently configured.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A horizontal mining system for excavating from a remote wellhead a generally horizontal borehole in a seam of material to be mined, said system comprising:

at least one water jet cutting head including a plurality of water jet nozzles mounted through a shield;

a drill string including a high pressure water supply extending from said wellhead for said at least one cutting head and a discharge pipe for conveying water and said mined material back to said wellhead;

a crawler adapted for supporting an end of said drill string and said at least one cutting head thereon for generation of said borehole;

at least one mined material crusher disposed upon said crawler for crushing said mined material excavated by said cutting head;

at least one jet pump disposed upon said crawler in flow communication with said crusher for propelling crushed, mined material into said discharge pipe; and means for guiding said cutting head in said excavation of said borehole.

2. The mining system as set forth in claim 1 wherein said shield is rotatably mounted to said crawler for cutting a generally cylindrical borehole.

3. The mining system as set forth in claim 1 wherein said shield is adapted for deflecting water and mined material while producing a borehole having a generally pie shaped cross section.

4. The mining system as set forth in claim 1 and including a second crusher disposed upon said crawler.

5. The mining system as set forth in claim 4 and including a second jet pump disposed upon said crawler in flow communication with said second crusher.

6. The mining system as set forth in claim 5 wherein said first and second jet pumps both feed into said discharge pipe on opposite sides thereof.

7. The mining system as set forth in claim 1 wherein said drill string further includes ventilation intake and exhaust lines.

8. The mining system as set forth in claim 1 wherein said material to be mined is coal.

9. The mining system as set forth in claim 8 wherein said coal is located in a relatively thin seam relative to its length.

10. A horizontal mining system for excavating from a remote wellhead a generally horizontal borehole in a seam of material to be mined said system comprising:

at least one water jet cutting head;

a drill string including a high pressure water supply extending from said wellhead for said at least one cutting head, a discharge pipe for conveying water and said mined material back to said wellhead, ventilation intake and exhaust lines, and a jet pump water line for activating at least one jet pump;

a crawler adapted for supporting an end of said drill string and said at least one cutting head thereon for generation of said borehole, at least one mined material crusher disposed upon said crawler for crushing said mined material excavated by said cutting head;

said at least one jet pump being disposed upon said crawler in flow communication with said crusher for propelling crushed, mined material into said discharge pipe; and means for guiding said cutting head in said excavation of said borehole.

11. A horizontal mining system for excavating from a remote wellhead a generally horizontal borehole in a seam of material to be mined, said system comprising:

at least one water jet cutting head;

a drill string including a high pressure water supply extending from said wellhead for said at least one cutting head and a discharge pipe for conveying water and said mined material back to said wellhead;

a crawler adapted for supporting an end of said drill string and said at least one cutting head thereon for generation of said borehole;

at least one mined material crusher disposed upon said crawler for crushing said mined material excavated by said cutting head;

at least one jet pump disposed upon said crawler in flow communication with said crusher for propelling crushed, mined material into said discharge pipe; and means for guiding said cutting head in said excavation of said borehole including a pilot borehole drilling system extending forward of said crawler.

12. The mining system as set forth in claim 11 wherein said pilot borehole drilling system includes a steering tool and water jet downhole motor.

13. The mining system as set forth in claim 12 and including a second crusher and a second jet pump disposed upon said crawler in flow communication with each other.

14. The mining system as set forth in claim 13 wherein both said cutting head and said downhole motor include a plurality of water jet nozzles adapted for eroding said material to be mined.

15. A method of mining for excavating from a remote wellhead a generally horizontal borehole in a seam of material to be mined, said method comprising the steps of:

providing at least one water jet cutting head;

assembling said cutting head with a plurality of water jet nozzles;

providing a shield and mounting said water jet nozzles through said shield;

providing a drill string including a high pressure water supply extending from said wellhead for said at least one cutting head and a discharge pipe for conveying water and said mined material back to said wellhead;

providing a crawler adapted for supporting an end of said drill string and said at least one cutting head thereon for generation of said borehole;

providing at least one mined material crusher upon said crawler for crushing said mined material excavated by said cutting head;

providing at least one jet pump upon said crawler in flow communication with said crusher for propelling crushed, mined material through said discharge pipe;

positioning said cutting head for excavation of said borehole;

discharging water through said cutting head to create said borehole; and guiding said crawler along said borehole in excavation of said material to be mined.

16. The method of mining a generally horizontal borehole as set forth in claim 15 including the step of rotatably mounting said shield to said crawler for cutting a generally cylindrical borehole in said material to be mined.

17. The method of mining a generally horizontal borehole as set forth in claim 15 including the step of positioning said shield for deflecting water and mined material while producing a borehole having a generally pie shaped cross section.

18. The method of mining a generally horizontal borehole as set forth in claim 15 including the step of mounting a second crusher upon said crawler.

19. The method of mining a generally horizontal borehole as set forth in claim 18 including the step of mounting a second jet pump upon said crawler in flow communication with said second crusher.

20. The method of mining a generally horizontal borehole as set forth in claim 19 including the step of mounting said first and second jet pumps to both feed into said discharge pipe on opposite sides thereof.

21. The method of mining a generally horizontal borehole as set forth in claim 15 including the step of assembling said drill string with ventilation intake and exhaust lines.

22. The method of mining a generally horizontal borehole as set forth in claim 15 including the step of designating said material to be mined as coal.

23. The method of mining a generally horizontal borehole as set forth in claim 22 including the step of locating said coal in a relatively thin seam relative to its length.

24. The method of mining a generally horizontal borehole as set forth in claim 23 including the step of excavating a series of parallel boreholes mined in said seam.

25. The method of mining a generally horizontal borehole as set forth in claim 24 including the step of leaving relatively thin webs of coal between adjacent boreholes for structural support of said excavation area.

26. The method of mining a generally horizontal borehole as set forth in claim 15 including the step of crushing said mined material into a size sufficiently small for passage through said jet pump.

27. The method of mining a generally horizontal borehole as set forth in claim 26 including the step of mixing said crushed mined material with water to create a slurry and passing said slurry through said discharge pipe for the recovery thereof.

28. A method of mining for excavating from a remote wellhead a generally horizontal borehole in a seam of material to be mined, said method comprising the steps of:

providing at least one water jet cutting head;

providing a drill string including a high pressure water supply extending from said wellhead for said at least one cutting head and a discharge pipe for conveying water and said mined material back to said wellhead;

assembling said drill string with ventilation intake and exhaust lines;

providing a crawler adapted for supporting an end of said drill string and said at least one cutting head thereon for generation of said borehole;

providing at least one mined material crusher upon said crawler for crushing said mined material excavated by said cutting head;

providing at least one jet pump upon said crawler in flow communication with said crusher for propelling crushed mined material through said discharge pipe;

assembling said drill string with a jet pump water line for activating said at least one jet pump;

positioning said cutting head for excavation of said borehole;

discharging water through said cutting head to create said borehole; and guiding said crawler along said borehole in excavation of said material to be mined.

29. A method of mining for excavating from a remote wellhead a generally horizontal borehole in a seam of material to be mined, said method comprising the steps of:

providing at least one water jet cutting head;

providing a drill string including a high pressure water supply extending from said wellhead for said at least one cutting head and a discharge pipe for conveying water and said mined material back to said wellhead;

providing a crawler adapted for supporting an end of said drill string and said at least one cutting head thereon for generation of said borehole;

providing at least one mined material crusher upon said crawler for crushing said mined material excavated by said cutting head;

providing at least one jet pump upon said crawler in flow communication with said crusher for propelling crushed, mined material through said discharge pipe;

positioning said cutting head for excavation of said borehole;

discharging water through said cutting head to create said borehole;

guiding said crawler along said borehole in excavation of said material to be mined;

and excavating a pilot borehole extending forward of said crawler.

30. The method of mining a generally horizontal borehole as set forth in claim 29 including the step of providing a pilot borehole drilling system with a steering tool and water jet downhole motor.

31. The method of mining a generally horizontal borehole as set forth in claim 30 and including the step of providing a second crusher and a second jet pump upon said crawler in flow communication with each other.

32. The method of mining a generally horizontal borehole as set forth in claim 31 including the step of providing both said cutting head and said downhole motor with a plurality of water jet nozzles adapted for eroding said material to be mined.

33. A coal mining system for substantially horizontal excavation of a borehole in a coal seam, said system comprising:

at least one water jet cutting head including a plurality of water jet nozzles mounted through a shield;

a drill string including a high pressure water supply for said at least one cutting head and a discharge pipe for conveying water and mined coal;

a crawler adapted for supporting an end of said drill string and said at least one cutting head thereon for generation of said borehole;

at least one crusher disposed upon said crawler for crushing said mined coal excavated by said cutting head; and at least one jet pump disposed upon said crawler in flow communication with said crusher for propelling crushed, mined coal into said discharge pipe.

34. The mining system as set forth in claim 33 and further including means for guiding said cutting head in said excavation of said coal.

35. The mining system as set forth in claim 33 wherein said shield is rotatably mounted to said crawler for cutting a generally cylindrical borehole.

36. The mining system as set forth in claim 33 and including a second crusher disposed upon said crawler.

37. The mining system as set forth in claim 36 and including a second jet pump disposed upon said crawler in flow communication with said second crusher.

38. A method of mining for excavating a generally horizontal borehole in a coal seam, said method comprising the steps of:

providing at least one water jet cutting head;

assembling said cutting head with a plurality of water jet nozzles;

providing a shield and mounting said water jet nozzles through said shield;

providing a drill string including a high pressure water supply for said at least one cutting head and a discharge pipe for conveying water and mined coal;

providing a crawler adapted for supporting an end of said drill string and said at least one cutting head thereon for generation of said borehole;

providing at least one crusher upon said crawler for crushing said mined coal excavated by said cutting head;

providing at least one jet pump upon said crawler in flow communication with said crusher for propelling crushed, mined coal through said discharge pipe; positioning said cutting head for excavation of said borehole; and discharging water through said cutting head to create said borehole.

39. The method of mining as set forth in claim 38 and further including the step of guiding said crawler along said borehole in excavation of said coal.

40. The method of mining as set forth in claim 38 including the step of rotatably mounting said shield to said crawler for cutting a generally cylindrical borehole in said coal.

41. The method of mining as set forth in claim 38 including the step of positioning said shield for deflecting water and mined coal while producing a borehole having a generally pie shaped cross section.

42. The method of mining as set forth in claim 38 including the step of mounting a second crusher upon said crawler.

43. The method of mining as set forth in claim 42 including the step of mounting a second jet pump upon said crawler in flow communication with said second crusher.

44. The method of mining as set forth in claim 43 including the step of mounting said first and second jet pumps to both feed into said discharge pipe on opposite sides thereof.

45. The method of mining as set forth in claim 38 including the step of assembling said drill string with ventilation intake and exhaust lines.

46. The method of mining as set forth in claim 38 including the step of locating said coal in a relatively thin seam relative to its length and excavating from an array of access tunnels therearound.

47. The method of mining as set forth in claim 46 including the step of excavating a series of parallel boreholes mined in said coal seam between said access tunnels.

48. The method of mining as set forth in claim 47 including the step of leaving relatively thin webs of coal between adjacent boreholes for structural support of said excavation area disposed between said access tunnels.

49. A method of mining a relatively thin seam of coal comprising the steps of:

defining a generally horizontal area of coal to be mined;

forming a first array of access tunnels around said area to be mined for exposing the coal seam therein;

providing at least one water jet cutting head in one of said access tunnels;

assembling said cutting head with a plurality of water jet nozzles;

providing a shield and mounting said water jet nozzles through said shield;

providing a drill string including a high pressure water supply for said at least one cutting head and a discharge pipe for conveying water and said mined coal back to said access tunnel;

providing a crawler adapted for supporting an end of said drill string and said at least one cutting head thereon for generation of said borehole;

providing at least one mined coal crusher upon said crawler for crushing said mined coal excavated by said cutting head;

providing at least one jet pump upon said crawler in flow communication with said crusher for propelling crushed, mined coal through said discharge pipe;

positioning said cutting head for excavation of said borehole;

discharging water through said cutting head to create said borehole; and guiding said crawler along said borehole in excavation of said coal to be mined.

50. The method of mining as set forth in claim 49 including the step of rotatably mounting said shield to said crawler for cutting a generally cylindrical borehole in said coal to be mined.

51. The method of mining as set forth in claim 49 including the step of positioning said shield for deflecting water and mined coal while producing a borehole having a generally pie shaped cross section.

52. The method of mining as set forth in claim 49 including the step of mounting a second crusher upon said crawler.

53. The method of mining as set forth in claim 49 including the step of mounting a second jet pump upon said crawler in flow communication with said second crusher.

54. The method of mining as set forth in claim 53 including the step of mounting said first and second jet pumps to both feed into said discharge pipe on opposite sides thereof.

55. The method of mining as set forth in claim 49 including the step of assembling said drill string with ventilation intake and exhaust lines.

56. The method of mining as set forth in claim 49 and further including the step of forming said plurality of boreholes in a second array, said second array being formed transverse to tunnels of said first array.

57. The method as set forth in claim 49 and further including the step of penetrating said coal seam with said boreholes spaced one from the other in generally spaced parallel relationship and defining a support web therebetween.

58. A method of mining a relatively thin seam of coal comprising the steps of:

defining a generally horizontal area of coal to be mined;

forming a first array of access tunnels around said area to be mined for exposing the coal seam therein;

providing at least one water jet cutting head in one of said access tunnels;

providing a drill string including a high pressure water supply for said at least one cutting head and a discharge pipe for conveying water and said mined coal back to said access tunnel;

assembling said drill string with ventilation intake and exhaust lines;

providing a crawler adapted for supporting an end of said drill string and said at least one cutting head thereon for generation of said borehole;

providing at least one mined coal crusher upon said crawler for crushing said mined coal excavated by said cutting head;

providing at least one jet pump upon said crawler in flow communication with said crusher for propelling crushed mined coal through said discharge pipe;

assembling said drill string with a jet pump water line for activating said at least one jet pump;

positioning said cutting head for excavation of said borehole;

discharging water through said cutting head to create said borehole; and guiding said crawler along said borehole in excavation of said coal to be mined.

59. A method of mining a relatively thin seam of coal comprising the steps of:

defining a generally horizontal area of coal to be mined;

forming a first array of access tunnels around said area to be mined for exposing the coal seam therein;

providing at least one water jet cutting head in one of said access tunnels;

providing a drill string including a high pressure water supply for said at least one cutting head and a discharge pipe for conveying water and said mined coal back to said access tunnel;

providing a crawler adapted for supporting an end of said drill string and said at least one cutting head thereon for generation of said borehole;

providing at least one mined coal crusher upon said crawler for crushing said mined coal excavated by said cutting head;

providing at least one jet pump upon said crawler in flow communication with said crusher for propelling crushed mined coal through said discharge pipe;

positioning said cutting head for excavation of said borehole;

discharging water through said cutting head to create said borehole;

guiding said crawler along said borehole in excavation of said coal to be mined; and excavating a pilot borehole extending forward of said crawler.

60. The method of mining as set forth in claim 59 including the step of providing a pilot borehole drilling system with a steering tool and water jet downhole motor.

61. A horizontal mining system for excavating from a remote wellhead a generally horizontal borehole in a seam of material to be mined, said system comprising:

a water jet cutting head;

a rigid drill string coupled to said cutting head and enclosing;

a high pressure water supply extending from said wellhead for said cutting head; and a discharge pipe for conveying water and said mined material back to said wellhead; and means for guiding said cutting head while excavating said borehole.

62. The mining system as set forth in claim 61 further comprising a crawler adapted for supporting an end of said drill string proximate said cutting head.

63. The mining system as set forth in claim 62 further comprising at least one mined material crusher disposed upon said crawler for crushing said mined material excavated by said cutting head.

64. The mining system as set forth in claim 63 further comprising at least one jet pump disposed upon said crawler in flow communication with said crusher for propelling crushed, mined material into said discharge pipe.

65. The mining system as set forth in claim 64 wherein said drill string further includes a jet pump water line for activating said at least one jet pump.

66. The mining system as set forth in claim 61 wherein said drill string has an end for removably coupling with a drill unit proximate said wellhead.

67. The mining system as set forth in claim 61 wherein said cutting head includes a plurality of water jet nozzles mounted through a shield.

68. The mining system as set forth in claim 61 wherein said guiding means includes a pilot borehole drilling system extending forward of said cutting head.

69. The mining system as set forth in claim 61 wherein said material to be mined is coal.

70. The mining system as set forth in claim 69 wherein said coal is located in a relatively thin seam relative to its length.

71. A method of mining for excavating from a remote wellhead a generally horizontal borehole in a seam of material to be mined, said method comprising the steps of:

providing a water jet cutting head;

providing a rigid drill string coupled to said cutting head and enclosing:

a high pressure water supply extending from said wellhead for said cutting head; and a discharge pipe for conveying water and said mined material back to said wellhead;

discharging water through said cutting head to create said borehole; and guiding said cutting head while excavating said borehole.

72. The method of mining set forth in claim 71 including the step of providing a crawler adapted for supporting an end of said drill string proximate said cutting head.

73. The method of mining set forth in claim 72 including the step of providing at least one mined material crusher upon said crawler for crushing said mined material excavated by said cutting head.

74. The method of mining set forth in claim 73 including the step of providing at least one jet pump upon said crawler in flow communication with said crusher for propelling crushed, mined material through said discharge pipe.

75. The method of mining set forth in claim 74 including the step of assembling said drill string with a jet pump water line for activating said at least one jet pump.

76. The method of mining set forth in claim 71 including the step of assembling said drill string with an end for removably coupling with a drill unit proximate said wellhead.

77. The method of mining set forth in claim 76 including the step of rotating said cutting head with said drill unit.

78. The method of mining set forth in claim 71, including the step of assembling said cutting head with a plurality of water jet nozzles mounted through a shield.

79. The method of mining set forth in claim 71, including the step of excavating a pilot borehole extending forward of said cutting head.

80. The method of mining set forth in claim 71, including the step of designating said material to be mined as coal.

81. The method of mining set forth in claim 80 wherein said coal is located in a relatively thin seam relative to its length.

* * * * *

UNITED STATES PATENT AND TRADEMARK OFFICE

CERTIFICATE OF CORRECTION

PATENT NO. : 5,879,057

DATED : Mar. 9, 1999

INVENTOR(S) : Schwoebel et al.

It is certified that error appears in the above-identified patent and that said Letters Patent is hereby corrected as shown below:

| | |
|---|---|
| Cover Page<br>Attorney, Agent, or Firm | Replace "Jenkins"<br>With --Jenkens-- |
| Column 13, line 36 | Replace "mined"<br>With --mined,-- |
| Column 13, line 46 | Replace "borehole,"<br>With --borehole;-- |
| Column 19, line 44 | Replace "enclosing;"<br>With --enclosing:-- |

Signed and Sealed this

Fifteenth Day of February, 2000

*Attest:*

Q. TODD DICKINSON

*Attesting Officer*

*Commissioner of Patents and Trademarks*